US009304421B2

(12) United States Patent
Sekiguchi et al.

(10) Patent No.: US 9,304,421 B2
(45) Date of Patent: Apr. 5, 2016

(54) ELECTROSTATIC LATENT IMAGE DEVELOPING TONER

(71) Applicant: Konica Minolta, Inc., Tokyo (JP)

(72) Inventors: Kouji Sekiguchi, Tokyo (JP); Tatsuya Nagase, Tachikawa (JP); Shiro Hirano, Hachioji (JP); Junya Onishi, Hachioji (JP); Kenshi Miyajima, Hino (JP); Tatsuya Fujisaki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/476,035

(22) Filed: Sep. 3, 2014

(65) Prior Publication Data

US 2015/0064616 A1 Mar. 5, 2015

(30) Foreign Application Priority Data

Sep. 5, 2013 (JP) ..... 2013-184081

(51) Int. Cl.
*G03G 9/08* (2006.01)
*G03G 9/087* (2006.01)

(52) U.S. Cl.
CPC ..... *G03G 9/0825* (2013.01); *G03G 9/08* (2013.01); *G03G 9/0819* (2013.01); *G03G 9/08704* (2013.01); *G03G 9/08711* (2013.01); *G03G 9/08755* (2013.01); *G03G 9/08788* (2013.01); *G03G 9/08795* (2013.01); *G03G 9/08797* (2013.01)

(58) Field of Classification Search
CPC ..... G03G 9/0825; G03G 9/08795; G03G 9/08755; G03G 9/08788
USPC ..... 430/109.3, 109.4, 110.1
See application file for complete search history.

(56) References Cited

U.S. PATENT DOCUMENTS

2003/0039910 A1* 2/2003 Shirai ..... G03G 9/081 430/109.4
2011/0244383 A1* 10/2011 Yamamoto ..... G03G 9/0806 430/105
2014/0287354 A1* 9/2014 Kawamura ..... G03G 9/0825 430/109.3
2014/0308611 A1* 10/2014 Shimano ..... G03G 9/08755 430/109.4
2014/0349231 A1* 11/2014 Shirai ..... G03G 9/0825 430/109.4
2014/0356780 A1* 12/2014 Kawamura ..... G03G 9/0804 430/109.3

(Continued)

FOREIGN PATENT DOCUMENTS

JP 02-029664 1/1990
JP 09-120176 5/1997

(Continued)

OTHER PUBLICATIONS

English language machine translation of JP 2011-180298 (Sep. 2011).*
Office Action dated Jul. 14, 2015 issued from the corresponding Japanese patent application No. 2013-184081.
English translation Office Action dated Jul. 14, 2015 issued from the corresponding Japanese patent application No. 2013-184081.

*Primary Examiner* — Christopher Rodee
(74) *Attorney, Agent, or Firm* — Lucas & Mercanti, LLP

(57) ABSTRACT

An electrostatic latent image developing toner includes a toner base particle which contains at least a binder resin, and has a domain-matrix structure, in which a matrix contains a styrene-acrylic resin, a domain contains an amorphous resin which is formed by combining a vinyl-based polymerized segment and a polyester-based polymerized segment, and the domain containing the amorphous resin and having a diameter of 100 nm or larger has a number-average domain diameter which falls in the range from 150 to 1000 nm.

9 Claims, 1 Drawing Sheet

(56) References Cited

U.S. PATENT DOCUMENTS

| | | | | |
|---|---|---|---|---|
| 2014/0363763 | A1* | 12/2014 | Shibata | G03G 9/08724 430/109.3 |
| 2014/0377699 | A1* | 12/2014 | Matsushima | G03G 9/0825 430/109.3 |
| 2015/0037718 | A1* | 2/2015 | Morita | G03G 9/0821 430/105 |
| 2015/0220011 | A1* | 8/2015 | Miyaake | G03G 9/0821 430/105 |

FOREIGN PATENT DOCUMENTS

| | | | | |
|---|---|---|---|---|
| JP | 2003302791 | A | * | 10/2003 |
| JP | 2005-173202 | A | | 6/2005 |
| JP | 2005-221933 | A | | 8/2005 |
| JP | 2005-338548 | A | | 12/2005 |
| JP | 2011-028257 | A | | 2/2011 |
| JP | 2011180298 | A | * | 9/2011 |
| JP | 2012-181410 | | | 9/2012 |

* cited by examiner

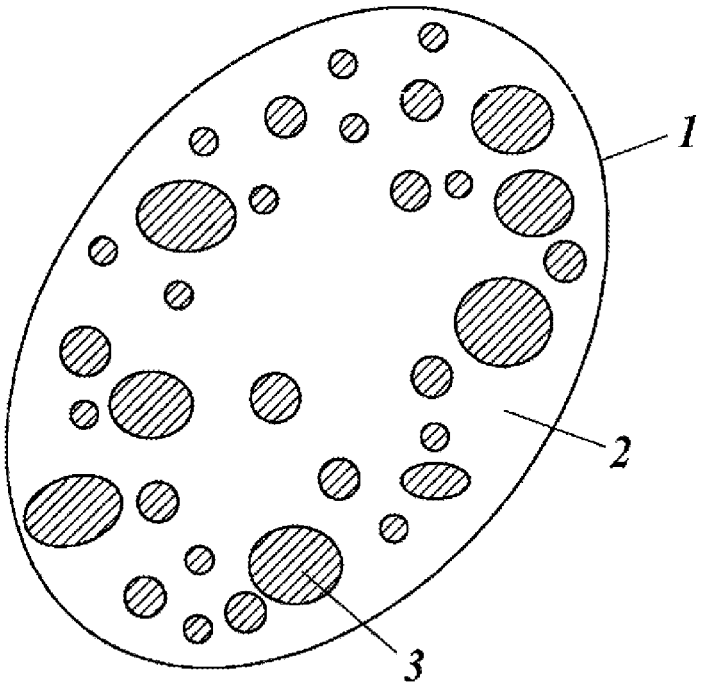
1
2
3

ELECTROSTATIC LATENT IMAGE DEVELOPING TONER

CROSS-REFERENCE TO RELATED APPLICATION

This application is based upon and claims the benefit of priority of the prior Japanese Patent Application No. 2013-184081, filed on Sep. 5, 2013, the entire contents of which are incorporated herein by reference.

BACKGROUND OF THE INVENTION

1. Field of the Invention

The present invention relates to an electrostatic latent image developing toner, and particularly to an electrostatic latent image developing toner which is excellent in low-temperature fixability and fixation separability, and is capable of yielding a toner image with an excellent high temperature offset resistance even on a rough paper having a large surface irregularity.

2. Description of Related Art

In a recent field of an electrostatic latent image developing toner (also simply referred to as "toner", hereinafter), in order to satisfy market needs, an electrophotographic device suitable for the needs, and the toner usable for the electrophotographic device have been developed at a high pace. For example, a toner compatible to higher image quality is required to have a sharp particle size distribution. By equalizing the sizes of toner particles to sharpen the particle size distribution, behaviors of the individual toner particles are equalized in developing, resulting in distinctive improvement in reproducibility of fine dots. However, it has not been easy to sharpen the particle size distribution of the toner, by conventional toner manufacturing methods using a pulverization process.

As a countermeasure, there has been proposed an emulsion flocculation method, as a manufacturing method which can arbitrarily control shapes and a particle size distribution of the toner particle. This method is implemented by mixing an emulsified dispersion of resin particles with a colorant particle dispersion and an optional wax particle dispersion, allowing the individual particles to flocculate by adding a flocculant and/or controlling pH under stirring, and then fusing the particles under heating, to thereby obtain the toner particle.

Meanwhile, from the viewpoint of energy saving, development has been ongoing for a low temperature fixable toner which is fixable with less energy. In order to lower the fixing temperature of toner, it is necessary to lower the melting temperature and melt viscosity of binder resin. However, lowering a glass transition point and a molecular weight of the binder resin, aimed at lowering the melting temperature and melt viscosity of the binder resin, results in another problem of degrading the heat-resistant storability and fixation separability of the toner.

There has been reported a technique to control the toner particle so that it has a core-shell structure, aiming at appropriately balancing the low-temperature fixability and heat-resistant storability (see Japanese Patent Application Laid-Open Publication No. 2005-221933, for example). More specifically, the low-temperature fixability and heat-resistant storability can be well balanced, by forming, over a surface of a core particle with an excellent low-temperature fixability, a shell layer composed of a resin with a high softening point and an excellent heat-resistant storability. In particular, such shape control can be easily performed in manufacturing of the toner by the emulsion flocculation method.

As an example of the toner having the core-shell structure, there has been developed a toner using a polyester resin for the shell layer of the toner particle (see Japanese Patent Application Laid-Open Publication No. 2005-338548, for example). The polyester resin is advantageous in that it may be easily designed to lower the softening point, while keeping the glass transition point higher as compared with a styrene-acrylic resin. By thus using the polyester resin for the shell layer, a toner with excellent low-temperature fixability and heat-resistant storability is obtainable.

However, the styrene-acrylic resin has only a poor affinity to the polyester resin, so that, for the case where the styrene-acrylic resin is used for the core and the polyester resin is used for the shell layer, it has been difficult to form a thin and uniform shell layer, and thereby a sufficient level of the heat-resistant storability has not been achieved. Moreover, due to poor fusion between the core and the shell, the shape control of the toner particle has been difficult, and it has consequently been difficult to produce a dense and smooth toner particle in which the shell layer has a uniform surface. Due to a poor anti-crush performance, the shell layer may separate under toner agitation in a developing machine during successive printing, and as a consequence, the amount of electrical charge would largely fluctuate, and an image would have noise and would be degraded in quality.

To solve these problems, there has been proposed a toner having the core-shell structure in which a urethane-modified polyester resin or acryl-modified polyester resin is used for the shell layer (see Japanese Patent Application Laid-Open Publication No. 2005-173202, for example). Also disclosed is a technique to improve the low-temperature fixability, anti-offset performance, and temperature dependence of the electrical charge amount, by using, for the binder resin of the toner, a resin obtained by combining a polyester resin unit via a divalent crosslinking group (see Japanese Patent Application Laid-Open Publication No. 2011-28257, for example).

By using the urethane-modified polyester resin or the acryl-modified polyester resin as a resin composing the shell layer for the purpose of improving affinity between the styrene-acrylic resin and the polyester resin, the shell layer with a certain level of uniformity has been obtained, even if the core was configured by the styrene-acrylic resin. The shell layer, however, has an elevated glass transition point due to absence of a styrene component, and this damages the low-temperature fixability. Further efforts of enhancing the low-temperature fixability, such as lowering the softening point of the core resin to further give the low-temperature fixability, again resulted in the degraded fixation separability and high temperature offset resistance. Such method is therefore still insufficient to satisfy all of the low-temperature fixability, fixation separability and high temperature offset resistance.

Meanwhile, in a recent field of production printing, a copying machine and a printer have been directed to a higher operating speed and a wider range of paper types applicable thereto. Since the higher operating speed means a shorter time a transfer medium passes through a fixing unit, so that the toner has been required to be fixable with a smaller amount of energy. Also the toner has been required to be fixable on transfer media which have conventionally been used only with difficulty, such as cardboard, envelope, rough paper with a large surface irregularity and so forth. In this situation, even the core-shell type toner described above has been insufficient to satisfy all of the low-temperature fixability, fixation separability and high temperature offset resistance.

Moreover, the toner particle having the core-shell structure as described above has been known to have another problem that it could not fully exhibit the heat characteristic ascribable to the resin composing the core particle, due to the presence of the shell layer over the surface of the toner particle.

SUMMARY OF THE INVENTION

The present invention has been mode in view of the problems and situations described above. It is therefore an object of the present invention to provide an electrostatic latent image developing toner which is excellent in low-temperature fixability and fixation separability, and is capable of yielding an excellent toner image with an excellent high temperature offset resistance even on a rough paper having a large surface irregularity.

In the process of investigating the above-described problems to be solved, the present inventors has found out that the above-described problems may be solved by using an electrostatic latent image developing toner which contains a toner base particle having a domain-matrix structure, the matrix containing a styrene-acrylic resin (1), the domain containing an amorphous resin (2) which is formed by combining a vinyl-based polymerized segment and a polyester-based polymerized segment, and the domain, configured by the amorphous resin, having a number-average domain diameter of 150 to 1000 nm. The finding led us to complete the present invention.

The problems regarding the present invention may be solved by the means below.

1. To achieve at least the above object, an electrostatic latent image developing toner reflecting one aspect of the present invention includes a toner base particle which contains at least a binder resin, and has a domain-matrix structure, wherein a matrix contains a styrene-acrylic resin (1), a domain contains an amorphous resin (2) which is formed by combining a vinyl-based polymerized segment and a polyester-based polymerized segment, and the domain containing the amorphous resin (2) and having a diameter of 100 nm or larger has a number-average domain diameter which falls in the range from 150 to 1000 nm.

2. Preferably, the number-average domain diameter of the toner base particle falls in the range from 300 to 800 nm.

3. Preferably, when a cross section of the toner base particle is dyed with ruthenium tetroxide and observed under an electron microscope, a total cross-sectional area of the domain accounts for 2 to 50% of a cross-sectional area of each the toner base particle.

4. More preferably, when a cross section of the toner base particle is dyed with ruthenium tetroxide and observed under an electron microscope, a total cross-sectional area of the domain accounts for 5 to 15% of a cross-sectional area of each the toner base particle.

5. Preferably, the binder resin contained in the toner base particle contains 5 to 70% by mass of the amorphous resin (2).

6. More preferably, the binder resin contained in the toner base particle contains 10 to 20% by mass of the amorphous resin (2).

7. Preferably, a proportion of a content of the vinyl-based polymerized segment in the amorphous resin (2) is 5 to 30% by mass.

8. Preferably, assuming a radius of the toner base particle as r, and a distance from a surface of the toner base particle to an r/2 point as a near-the-surface range, 80% by volume or more of the amorphous resin (2) resides in the near-the-surface range of the toner base particle.

9. Preferably, in the matrix including at least the styrene-acrylic resin (1), the domain of the amorphous resin (2) and a domain of a mold releasing agent are scattered, and the amorphous resin (2) and the mold releasing agent independently form the respective domains.

BRIEF DESCRIPTION OF THE DRAWINGS

FIGURE is a schematic cross sectional view of a toner base particle of the present invention for explaining the configuration of the toner base particle.

DESCRIPTION OF EMBODIMENTS

The electrostatic latent image developing toner of the present invention includes a toner base particle which contains at least a binder resin, and has a domain-matrix structure. The matrix contains a styrene-acrylic resin (1), and the domain contains an amorphous resin (2) which is formed by combining a vinyl-based polymerized segment and a polyester-based polymerized segment. The domain, which contains the amorphous resin (2), has a number-average domain diameter of 150 to 1000 nm, when measured among those having a diameter of 100 nm or larger. This feature is common to all inventions according to item 1 to item 9.

In an embodiment of the present invention, from the viewpoint of expression of the effect of the present invention, when the number-average domain diameter of the toner base particle falls in the range from 300 to 800 nm, the total area of interface with the styrene-acrylic resin (1) will fall in a preferable range, and thereby the low-temperature fixability and the fixation separability are preferably improved.

When a cross section of the toner base particle is dyed with ruthenium tetroxide and observed under an electron microscope, the total cross-sectional area of the domain preferably accounts for 2 to 50% of the cross-sectional area of a single toner base particle, since in this range, both of the matrix resin and the domain resin can independently express performances of their own, and thereby the low-temperature fixability and the fixation separability are well balanced.

Moreover, when a cross section of the toner base particle is dyed with ruthenium tetroxide and observed under an electron microscope, the total cross-sectional area of the domain more preferably accounts for 5 to 15% of the cross-sectional area of a single toner base particle, since in this range, both of the matrix resin and the domain resin can independently express performances of their own, and thereby the low-temperature fixability and the fixation separability are further well balanced.

The binder resin contained in the toner base particle preferably contains 5 to 70% by mass of the amorphous resin (2), in view of improving the temperature fixability.

The binder resin contained in the toner base particle more preferably contains 10 to 20% by mass of the amorphous resin (2), in view of further improving the low-temperature fixability.

The proportion of the content of the vinyl-based polymerized segment in the amorphous resin (2) is preferably 5 to 30% by mass, in view of imparting affinity with the styrene-acrylic resin (1) which configures the matrix.

Assuming now the radius of the toner base particle as r, and the range of the toner base particle from the surface to r/2 as a near-the-surface range, 80% by volume or more of the amorphous resin (2) preferably resides in the near-the-surface range of the toner base particle, in view of predominantly expressing the sharp-melting performance of the polyester resin.

Moreover, it is preferable that, in the matrix which is configured by at least the styrene-acrylic resin (1), a domain of the amorphous resin (2) and a domain of a mold releasing agent are scattered, and each of the amorphous resin (2) and the mold releasing agent independently forms the domain of its own, in view of facilitating expression of the individual characteristics of the resins which form the domains.

Components of the present invention, and embodiments and modes for carrying out the present invention will be detailed below. Note that in this specification, the wording "to" accompanied by the preceding and succeeding numerals will be used to indicate a numerical range defined by the lower limit value and the upper limit value respectively represented by these numerals.

<<Electrostatic Latent Image Developing Toner>>

The electrostatic latent image developing toner includes a toner base particle which contains at least a binder resin, and has a domain-matrix structure, in which the matrix contains a styrene-acrylic resin (1), and the domain contains an amorphous resin (2) which is formed by combining a vinyl-based polymerized segment and a polyester-based polymerized segment. The domain, which contains the amorphous resin (2), has a number-average domain diameter of 150 to 1000 nm, when measured among those having a diameter of 100 nm or larger.

In the toner base particle of the present invention, the styrene-acrylic resin (1) as the binder resin composing the matrix functions to improve the high temperature offset resistance and the fixation separability, and the amorphous resin (2) as the binder resin composing the domain functions to improve the low-temperature fixability. In the present invention, the binder resin composing the matrix may any resin as long as it contains the styrene-acrylic resin (1), and may also contain other resin so long as the content of which does not exceed the content of the styrene-acrylic resin (1).

Configuration of the present invention will be explained below by items.

<<Structure of Toner Base Particle>>

The toner base particle of the present invention is configured so that the above-described amorphous resin (2) resides as the domain in the above-described matrix formed by the styrene-acrylic resin (1). The domain, which contains the amorphous resin (2), has a number-average domain diameter of 150 to 1000 nm, when measured among those having a diameter of 100 nm or larger.

If the number-average diameter of domain falls below 150 nm, the characteristic of the styrene-acrylic resin (1) which configures the matrix is predominantly expressed over that of the amorphous resin (2) which configures the domain, so that the low-temperature fixability may be degraded, whereas if it exceeds 1000 nm, the characteristic of the amorphous resin (2) which configures the domain is predominantly expressed over that of the styrene-acrylic resin (1) which configures the matrix, so that the high temperature offset resistance may be degraded.

The number-average diameter of domain more preferably falls in the range from 300 to 800 nm. In the above-described range, the total area of interface with the styrene-acrylic resin (1) falls in a preferable range, thereby the mold releasing agent in the molten state will become more movable, the characteristics of both resins of the styrene-acrylic resin (1) which configures the matrix and the amorphous resin (2) which configures the domain, and the characteristics of the mold releasing agent are respectively expressed in an efficient manner, and thereby the low-temperature fixability and the fixation separability may be improved. By controlling the domain diameter in the above-described range, the amount of the styrene-acrylic resin (1) in the near-the-surface range of the toner particle may be controlled in a preferable range, so that a toner image with an excellent high temperature offset resistance is obtainable even if a rough paper with a large surface irregularity is used.

FIGURE is a schematic cross sectional view of a toner base particle 1 for explaining the configuration of the toner base particle of the present invention. In the illustrated example, domains 3 are scattered, namely, exist so as to be isolated, in a matrix 2 of the toner base particle 1.

In the present invention, the number-average diameter of the domain which contains the amorphous resin (2) is controllable within the range from 150 to 1000 nm, by using the amorphous resin (2) which has a content of vinyl-based polymerized segment of 5 to 30% by mass, and an HSP distance away from the styrene-acrylic resin (1) of 5.0 to 8.0 $(J/cm^3)^{1/2}$, wherein the amorphous resin (2) is charged in the early stage of the flocculation process of resin when the toner base particle is produced.

When the cross section of the toner base particle of the present invention is dyed with ruthenium tetroxide ($RuO_4$) and observed under an electron microscope, the total cross-sectional area of the domain, which contains the amorphous resin (2), preferably accounts for 2 to 50% of the cross-sectional area of a single toner base particle, and more preferably 5 to 15%. By controlling the total cross-sectional area of the domain which contains the amorphous resin (2) in these ranges, the low-temperature fixability inherent to the amorphous resin (2) which configures the domain, is fully expressed, and thereby the toner will have excellent low-temperature fixability.

<Methods of Measuring Diameter, Area and Volume of Domain>

Methods of measuring the number-average diameter, the area and the volume of the domain contained in the toner base particle in the present invention will be described below.

(1. Observation of Domain Structure)

Evaluation Apparatus: a scanning transmission electron microscope "JSM-7401F" (from JEOL, Ltd.)

Evaluation Sample: a sample slice of toner dyed with $RuO_4$ (100 to 200 nm thick)

Acceleration Voltage: 30 kV

Magnification: 10000×, bright-field image (2. Method of Producing Sample Slice of Toner and Method of Identification)

[Production of Sample Slice of Toner]

The toner base particle is dispersed in a photo-curable resin (D-800, from JEOL, Ltd.), allowed to cure under light, to form a block. The block is then sliced using a microtome equipped with a diamond blade, to produce a thin sample slice of 100 to 200 nm thick, and the sample slice is placed on a grid with a support film for observation under a transmission electron microscope.

Filter paper is placed in a 5-cm-diameter plastic dish, and the grid having the sample slice placed thereon is placed on the filter paper, with the sample slice faced up.

Dying conditions (time, temperature, concentration and amount of dye) are controlled so as to enable discrimination of the individual resins when observed under the transmission electron microscope. For example, two or three droplets of a 0.5% $RuO_4$ dying solution are placed at two spots in the dish, the dish is closed with a lid, allowed to stand for 10 minutes, the dish is unlidded, and allowed to stand until water in the dying solution dries up.

[Identification]

The resin components in the toner base particle are identified based on the criteria below:

Area, looks dark: styrene-acrylic resin (1)

Area, looks bright: amorphous resin (2)

Area, looks bright, with dark boundary: mold releasing agent (3. Measurement of Number-Average Diameter, Area and Volume of Domain)

Evaluation Apparatus: transmission electron microscope (same as that used in "Observation of Domain Structure")

Image Processor: "LUZEX (registered trademark) AP" (from Nireco Corporation)

Evaluation Conditions Method of obtaining a toner image to be measured is same as described in "Observation of Domain Structure".

[Measurement Method]

Twenty-five or more fields of view of the toner base particle image, having the cross sectional diameter within a ±10% range on both sides of the volume-average particle size ($D_{50}$%), are selected for measurement. From these 25 fields of view of the toner base particle image, 200 or more domains of 100 nm or larger, which contain the amorphous resin (2), are randomly selected and subjected to measurement of diameter.

The number-average diameter of the domain is calculated as an average value of the horizontal Feret's diameter, and the area of domain is obtained by measuring an actual area of the domains each having a particle size of 100 nm or larger. Now the horizontal Feret's diameter is given by the length of an edge, parallel to the x-axis, of a bounding rectangle drawn on a binarized image of the external additive.

The volume of the domain is calculated using the thus-determined diameter of domain and the volume-average particle size of the toner base particle, while assuming each of the domain and the toner base particle as a sphere. The proportion of the volume of the domain, which contains the amorphous resin (2), contained in the near-the-surface range of the toner base particle is determined first by calculating an abundance proportion of the domain, which contains the amorphous resin (2), in the near-the-surface range of the toner particle, based on the total volume of the domain which contains the amorphous resin (2) contained in the near-the-surface range of the toner base particle, and the total volume of the domains which contains the amorphous resin (2) and resides inside the toner base particle, and then by multiplying the amount of addition (mass) of the amorphous resin (2), by the above-calculated abundance proportion of the domain which contains the amorphous resin (2) in the near-the-surface range of the toner.

<Method of Measuring Volume-Average Particle Size ($D_{50}$%) of Toner Base Particle>

The volume-based median diameter ($D_{50}$%) of the toner particle, in the measurement of diameter and area of the domain, may be determined as described below.

Evaluation Apparatus Coulter counter "Multisizer 3" (from Beckman Coulter, Inc.), connected with a computer system (from Beckman Coulter, Inc.) installed with a data processing software "Software V3.51"

Evaluation Conditions: 0.02 g of toner base particles is wetted with 20 ml of a surfactant solution, and dispersed by sonication for one (1) minute, to produce a dispersion of the toner base particles.

The evaluation apparatus is set so that a concentration displayed on the apparatus is 5 to 50%, the number of counts of measured particles is 25000, and an aperture diameter is 100 μm.

Evaluation Method: The measurement range from 2.0 to 60 μm is divided into 256 sections to find a frequency value in each section, and a particle size (volume-based median diameter) which falls on the 50% point of a volume-based cumulative fraction, from the maximum particle size, is defined as the volume-average particle size (volume $D_{50}$%).

In the present invention, the binder resin which configures the toner base particle preferably contains 5 to 70% by mass, and more preferably 10 to 20% by mass, of the amorphous resin (2). By controlling the content of the amorphous resin (2) in the above-described ranges, the resin characteristic inherent to the amorphous resin (2) is fully expressed, and thereby the toner will have excellent low-temperature fixability, fixation separability and high temperature offset resistance.

Assuming now the radius of the toner base particle as r, and the range of the toner base particle from the surface to r/2 as a near-the-surface range of the toner base particle, 80% by volume or more, and more preferably 85% by volume, of the amorphous resin (2) preferably resides in the near-the-surface range of the toner base particle. When 80% by volume or more of the amorphous resin (2) resides in the near-the-surface range, the amorphous resin (2) which configures the domain will be more likely to express the characteristic thereof, and thereby the low-temperature fixability will be improved.

In the present invention, a possible method of localizing 80% by volume or more of the amorphous resin (2) into the near-the-surface range is as follows.

In order to localize 80% by volume or more of the domain of the amorphous resin (2) into the near-the-surface range of the toner base particle, the HSP distance, known as a vector distance in conjunction with Hansen's SP parameter (also referred to as "HSP value", hereinafter), between the styrene-acrylic resin (1) which configures the matrix and the amorphous resin (2) preferably falls in the range from 5.0 to 8.0 $(J/cm^3)^{1/2}$. By controlling the HSP distance in the range, the amorphous resin (2) can form the domain by a balance of affinity with the styrene-acrylic resin (1). The proportion of 80% by volume or more is also achieved by an effect of outgoing tendency of the amorphous resin (2) which has a higher hydrophilicity than the styrene-acrylic resin (1) has.

(HSP Value)

The HSP value (Hansen Solubility Parameter) is a three-dimensional vector expression of a solubility parameter (SP value) divided into three terms of a dispersion term (dD), polarity term (dP), hydrogen bonding term (dH). The HSP value peculiar to each substance is defined by the equation (1) below. This idea proposed by Hansen is described by Hiroshi Yamamoto, Steven Abbott, and Charles M. Hansen in "*Kagaku Kogyo* (Chemical Engineering), March 2010", published by Kagaku Kogyo Sha.

$$\text{HSP value}=(dD^2+dP^2+dH^2)^{1/2} \quad \text{Equation (1)}$$

dD: dispersion term dP: polarity term dH: hydrogen bonding term (HSP Distance)

The HSP distance is a distance between vectors, in Hansen space, of arbitrary different substances such as solvent, polymer and so forth. This is an index of describing that "the smaller the HSP distance, the larger the solubility". The HSP distance is defined by the equation (2) below. This idea proposed by Hansen is described by Hiroshi Yamamoto, Steven Abbott, and Charles M. Hansen in "*Kagaku Kogyo* (Chemical Engineering), April 2010", published by Kagaku Kogyo Sha.

$$\text{HSP distance}=(4\times(dD_1-dD_2)^2+(dP_1-dP_2)^2+(dH_1-dH_2)^2)^{1/2} \quad \text{Equation (2)}$$

$dD_1$: dispersion term of arbitrary substance 1
$dD_2$: dispersion term of arbitrary substance 2
$dP_1$: polarity term of arbitrary substance 1
$dP_2$: polarity term of arbitrary substance 2
$dH_1$: hydrogen bonding term of arbitrary substance 1
$dH_2$: hydrogen bonding term of arbitrary substance 2

In the present invention, the HSP value and the HSP distance are specifically determined as described below:

1) Group molar attraction constants (Fdi, Fpi, Ehi) and the molar volume (Vi) of the individual functional groups are calculated referring to the description and the method disclosed in "*Properties of Polymers, Chapter 7: Cohesive Properties and Solubility*, p. 129-158, (by D. W. Van Krevelen, published by Elsevier Scientific Publishing Company, 5th edition, 1989)".

2) Unit group molar attraction constants of the polymer (resin) are calculated using the individual group molar attraction constants (Fdi, Fpi, Ehi) determined in 1) above, and molar volume (Vi) of the individual functional groups, according to the equations (3), (4) and (5) below:

$$dD=\Sigma Fdi/\Sigma Vi \quad \text{Equation (3)}$$

$$dP=(\Sigma(Fpi)^2)^{1/2}/\Sigma Vi \quad \text{Equation (4)}$$

$$dH=(\Sigma Ehi/\Sigma Vi)^{1/2} \quad \text{Equation (5)}$$

3) For polymers (copolymers) containing a plurality of monomer units, molar abundance proportions of the individual unit monomers are multiplied in the calculation.

The HSP values and the HSP distances used in the present invention are determined as described above.

By controlling the HSP distance fallen in the above described range, the styrene-acrylic resin (1) and the amorphous resin (2) are more likely to flocculate and fuse in the process of manufacturing the toner base particle, and after the flocculation, the highly hydrophilic amorphous resin (2) tends to reside in the near-the-surface range of the particle, so that the abundance of the amorphous resin (2) in the near-the-surface range of the matrix may be 80% by volume or more. Also the diameter of the domain of the amorphous resin (2) in the matrix may be controlled to fall in the above-described range. The reason why the diameter of the domain may be controlled in the above-described preferable range by controlling the HSP value in the above-described range, is that the affinity between the styrene-acrylic resin (1) and the amorphous resin (2) may be controlled by appropriately balancing the proportion of vinyl-based polymerized segment in the amorphous resin (2) and the HSP value, and thereby the total area of the interface between the resins is properly adjustable.

In the present invention, it is preferable that the domain of the amorphous resin (2) and the domain of the mold releasing agent are scattered (exists in a distributed manner) in the matrix configured by the styrene-acrylic resin (1), wherein the domains are preferably formed independently. So long as the domains are kept isolated, the domains may come into contact with each other, or may exist in an isolated manner, wherein the domains preferably exist in an isolated manner. For the individual domains to be kept isolated, the HSP distance between the amorphous resin (2) and the mold releasing agent preferably falls in the range from 5.0 to 11.0 $(J/cm^3)^{1/2}$. By virtue of the individual domains kept isolated, the characteristic of the amorphous resin (2) which configures the domain, and the characteristic of the mold releasing agent may be expressed independently. Note that the "domains are formed independently" means that each of the amorphous resin (2) and the mold releasing agent independently forms the domain, without being mixed with each other.

Next, Materials for composing the toner base particle will be explained.

<<Styrene-Acrylic Resin (1) (Matrix)>>

The styrene-acrylic resin (1) contained in the matrix which configures the toner base particle of the present invention is an amorphous resin in which styrene-based monomer and acrylic monomer are polymerized.

The polymerizable monomer used for the styrene-acrylic resin (1) includes aromatic vinyl monomer and (meth)acrylate ester-based monomer, where those having an ethylenic unsaturated bond capable of taking part in radical polymerization are preferable. Examples include styrene-based monomer such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and derivatives of these compounds. Each of these aromatic vinyl monomer may be used independently or, two or more species may be used in combination.

The acrylic monomer is exemplified by acrylic acid ester-based monomers such as methyl acrylate, ethyl acrylate, butyl acrylate, 2-ethylhexyl acrylate, cyclohexyl acrylate and phenyl acrylate; and methacrylic acid ester-based monomers such as methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, and diethylaminoethyl methacrylate. Each of these (meth)acrylate ester-based monomers may be used independently, or, two or more species may be used in combination. Among the compounds exemplified above, styrene-based monomer is preferably used in combination with either acrylate ester-based monomer or methacrylate ester-based monomer.

Also a third vinyl-based monomer may be used as other polymerizable monomer. The third vinyl-based monomer is exemplified by acid monomers such as acrylic acid, methacrylic acid, maleic anhydride, and vinyl acetate; and and acrylamide, methacrylamide, acrylonitrile, ethylene, propylene, butyrene-vinyl chloride, N-vinylpyrrolidone and butadiene.

Also multi-functional vinyl-based monomer may be used as the polymerizable monomer. The multi-functional vinyl-based monomer is exemplified by diacrylates of ethylene glycol, propylene glycol, butyrene glycol and hexylene glycol; and dimethacrylates and/or trimethacrylate of divinylbenzene, and trihydric or higher hydric alcohols such as pentaerythritol and trimethylolpropane. The copolymerization ratio of the multi-functional vinyl-based monomer relative to the total polymerizable monomers is generally 0.001 to 5% by mass, preferably 0.003 to 2% by mass, and more preferably 0.01 to 1% by mass. By using the multi-functional vinyl-based monomer, a gel component insoluble to tetrahydrofuran will generate, wherein the percentage of the gel component to the entire polymer is generally 40% by mass or less, and preferably 20% by mass or less.

The glass transition point (Tg) of the styrene-acrylic resin (1) which configures the matrix preferably falls in the range from 40 to 60° C.

The softening point of the styrene-acrylic resin (1) is preferably 80 to 120° C. By controlling the glass transition point and the softening point of the binder resin which configures the matrix, both of the high temperature offset resistance and the fixation separability are expressed well.

<Method of Measuring Glass Transition Point (Tg)>

The glass transition point of the styrene-acrylic resin (1) is measured according to a method specified by ASTM (American Society for testing and Materials) Standard D3418-82 (DSC method).

Specifically, 4.5 mg of the sample is precisely weighed to two decimal places, enclosed in an aluminum pan, and set on a sample holder of a differential scanning calorimeter "DSC8500" (from PerkinElmer Inc.). A vacant aluminum pan is used for a control experiment. Measurement is conducted over a temperature range from −10 to 120° C., at a rate of heating of 10° C./min, a rate of cooling of 10° C./min, according to a cycle of heating-cooling-heating. Data obtained during the second heating is analyzed. The glass transition temperature is determined by the intersection of a line extended from the base line before the first endothermic peak rises up, and a tangent line which represents the maximum slope of the first endothermic peak within the range from the rise-up point to the apex of the peak.

<Method of Measuring Softening Point (Tsp)>

The softening point (Tsp) of the styrene-acrylic resin (1) is measured as follows.

Under an environment of 20° C.±1° C. and 50%±5% RH, 1.1 g of resin is placed flat in a dish, and allowed to stand for 12 hours or longer. The sample is then compressed using a handpress "SSP-10A" (from Shimadzu Corporation) under a force of 3820 kg/cm$^2$ for 30 seconds, to thereby form a molded cylindrical sample of 1 cm in diameter. Next, the molded sample is placed under an environment of 24° C.±5° C. and 50%±20% RH, set on a flow tester "CFT-500D" (from Shimadzu Corporation) under conditions including a load of 196 N (20 kgf), a start temperature of 60° C., a preheating time of 300 seconds, and a rate of heating of 6° C./min, and upon completion of the preheating, the sample is extruded through a hole (1 mm ϕ×1 mm) of a circular cylindrical die, using a 1-cm-diameter piston. The softening point of the resin is determined by a temperature $T_{offset}$ measured by the offset method with an offset of 5 mm, in the measurement of fusion temperature under heating.

<Method of Manufacturing Styrene-Acrylic Resin (1)>

The styrene-acrylic resin (1) which configures the matrix in the present invention is preferably manufactured by emulsion polymerization. Emulsion polymerization is conducted by dispersing polymerizable monomers such as styrene, acrylic ester and so forth in an aqueous medium, and allowing them to polymerize. A surfactant is preferably used in order to dispersing the polymerizable monomer into the aqueous medium, and also a polymerization initiator and a chain transfer agent are preferably used for polymerization.

(Polymerization Initiator)

The polymerization initiator used for polymerization of the styrene-acrylic resin (1) is selectable from known products without special limitation. Specific examples include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl persulfate, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butyl performate, tert-butyl peracetate, tert-butyl perbenzoate, tert-butyl perphenylacetate, tert-butyl permethoxyacetate, and tert-butyl N-(3-tolyl)perpalmitate; and azo compounds such as 2,2'-azobis(2-aminodipropane) hydrochlorate, 2,2'-azobis-(2-aminodipropane) nitrate, 1,1'-azobis(sodium 1-methylbutyronitrile-3-sulfonate), 4,4'-azobis-4-cyanovaleric acid, and poly(tetraethylene glycol-2,2'-azobisisobutyrate). While the amount of addition of the polymerization initiator may vary depending on desired levels of molecular weight and molecular weight distribution, it is preferably 0.1 to 5% by mass of the polymerizable monomer.

(Chain Transfer Agent)

In the manufacture of the styrene-acrylic resin (1) in the present invention, a chain transfer agent may be added together with the polymerizable monomer. By adding the chain transfer agent, the molecular weight of the monomer may be controlled. In the above-described polymerization step for polymerizing the aromatic vinyl monomer and the (meth)acrylate ester-based monomer, any of general chain transfer agents is usable for the purpose of appropriately adjusting the molecular weight of the styrene-acrylic polymerized segment. The chain transfer agent is exemplified by alkyl mercaptan and mercaptofatty acid ester, without special limitation.

While the amount of addition of the chain transfer agent may vary depending on desired levels of molecular weight and molecular weight distribution, it is preferably 0.1 to 5% by mass of the polymerizable monomer.

(Surfactant)

In the process of polymerization, based on emulsion polymerization, of the styrene-acrylic resin (1) dispersed in an aqueous medium, it is general to add a dispersion stabilizer in order to prevent flocculation of the dispersed droplets. Any of known surfactants is usable as the dispersion stabilizer, which is selectable from cationic surfactant, anionic surfactant and nonionic surfactant. Two or more species of the surfactants may be used in combination. The dispersion stabilizer is also usable for dispersions of colorant and anti-offset agent.

Specific examples of the cationic surfactant include dodecylammonium bromide, dodecyltrimethylammonium bromide, dodecylpyridinium chloride, dodecylpyridinium bromide, and hexadecyltrimethylammonium bromide.

Specific examples of the nonionic surfactant include dodecyl polyoxyethylene ether, hexadecylpolyoxyethylene ether, nonylphenylpolyoxyethylene ether, laurylpolyoxyethylene ether, sorbitan monooleate polyoxyethylene ether, styrylphenyl polyoxyethylene ether, and monodecanoyl sucrose.

Specific examples of the anionic surfactant include aliphatic soaps such as sodium stearate and sodium laurate; and sodium laurylsulfate, sodium dodecylbenzensulfonate, and sodium polyoxyethylene (2) laurylethersulfate. Each of these surfactants may be used independently, or, two or more species may be used in combination, depending on needs.

<<Amorphous Resin (2) (Domain) Having Vinyl-Based Polymerized Segment Combined with Polyester-Based Polymerized Segment>>

Next, the amorphous resin (2) which configures the domain of the toner base particle will be explained.

In the present invention, the amorphous resin (2) refers to a resin which is formed by combining the vinyl-based polymerized segment typically configured by the styrene-acrylic polymer, and the polyester-based polymerized segment configured by the amorphous polyester resin, while placing a bireactive monomer in between. The vinyl-based polymerized segment refers to a polymer moiety obtained by polymerizing an aromatic vinyl-based monomer and a (meth) acrylate ester-based monomer.

In the present invention, the proportion of the content of the vinyl-based polymerized segment in the amorphous resin (2), used as the binder resin of the domain which configures the toner base particle (also referred to as "amount of styrene-acryl modification") is 5 to 30% by mass or below, and particularly 5 to 10% by mass or below. By controlling the content in these ranges, the domain will more easily have a desirable diameter, by contribution of affinity between the styrene-acrylic resin (1) and the amorphous resin (2).

The proportion of the content of the vinyl-based polymerized segment in the amorphous resin (2), or the amount of styrene-acryl-modification, specifically refers to the percentage of mass of the aromatic vinyl monomer and the (meth) acrylate ester-based monomer which compose the vinyl-based polymerized segment, relative to the total mass of the resin materials used for synthesizing the amorphous resin (2), that is, the total mass obtained by summing up the mass of polymerizable monomer for forming the unmodified polyester resin to be incorporated into the polyester-based polymerized segment, the mass of aromatic vinyl monomer and (meth)acrylate ester-based monomer to be incorporated into the vinyl-based polymerized segment, and the mass of bireactive monomer for combining these segments.

By controlling the amount of styrene-acryl-modification into the above-described ranges, the affinity between the styrene-acrylic resin (1) which configures the matrix and the amorphous resin (2) which configures the domain will be controlled to an appropriate level, and thereby the toner base particle having the domain-matrix structure is properly formed.

In the toner of the present invention, the unsaturated aliphatic dicarboxylic acid is used as the polybasic carboxylic acid monomer, in order to form the polyester-based polymerized segment of the amorphous resin (2), wherein a structural unit derived from the unsaturated aliphatic dicarboxylic acid is preferably contained in the polyester-based polymerized segment. The unsaturated aliphatic dicarboxylic acid refers to a chain-like dicarboxylic acid having a vinylene group in the molecule thereof. The structural unit herein means a unit of molecular structure derived from the monomer in the resin.

By using the amorphous resin (2), which has the structural unit derived from the unsaturated aliphatic dicarboxylic acid, for the domain, the toner will have the sharp-melting performance ascribable to the ester group in the principal chain of the amorphous resin (2), and thereby the toner will have an excellent low-temperature fixability.

The proportion of the content of the structural unit derived from the unsaturated aliphatic dicarboxylic acid (also referred to as "the proportion of the content of specific unsaturated dicarboxylic acid", hereinafter), relative to the structural unit derived from the polybasic carboxylic acid monomer for composing the polyester-based polymerized segment in the amorphous resin (2) is preferably 5 to 85 mol %, more preferably 25 to 83 mol %, and particularly 40 to 80 mol %.

By controlling the proportion of the content of the specific unsaturated dicarboxylic acid in the above-described ranges, the affinity between the styrene-acrylic resin (1) and the amorphous resin (2) will be controlled to an appropriate level, and thereby the amorphous resin (2) can form the domain in the toner particle.

The structural unit derived from the unsaturated aliphatic dicarboxylic acid is preferably derived from the compound represented by the formula (A) below:

$$HOOC—(CR_1{=}CR_2)_n—COOH \qquad \text{Formula (A):}$$

(where, each of $R_1$ and $R_2$ represents a hydrogen atom, methyl group or ethyl group, which may be same or different from each other. n is an integer of 1 or 2.)

By containing such structural unit derived from the unsaturated aliphatic dicarboxylic acid, an excellent domain-matrix structure may be obtained. In the present invention, the unsaturated aliphatic dicarboxylic acid represented by the formula (A) may be used for the polymerization reaction in the form of anhydride.

More specifically, since the polyester resin is generally hydrophobic, so that when the toner particle is manufactured by emulsion flocculation described later, the polyester resin particles may flocculate under the presence of the matrix which is configured by the styrene-acrylic resin (1), which is known as so-called "homo flocculation". The homo-flocculation, however, becomes less likely to occur, when the polyester molecule have therein a carbon-carbon double bond and thereby increased in hydrophilicity. By virtue of such increase in hydrophilicity of the polyester resin, in the process of manufacturing of the toner particle in the aqueous medium by emulsion flocculation, the polyester-based polymerized segment will be more likely to be directed to the opposite side of the styrene-acrylic resin (1), or inwardly into the domain. It now becomes possible to form the domain-matrix structure.

Accordingly, as described previously, by using the amorphous resin (2) as the resin which configures the domain, the styrene-acrylic components of the styrene-acrylic resin (1) which configures the matrix align, while keeping the affinity with the vinyl-based polymerized segment of the amorphous resin (2) which configures the domain, and by contribution of the carbon-carbon double bond in the polyester-based polymerized segment to enhance the hydrophilicity, it supposedly becomes possible to form the domain-matrix structure.

When the amorphous resin (2) in the present invention is used for the domain, the glass transition point is preferably 40 to 70° C. from the viewpoint of low-temperature fixability, more preferably 45 to 65° C., preferably with a softening point of 80 to 110° C.

<Method of Measuring Glass Transition Point (Tg)>

The glass transition point of the amorphous resin (2) is measured according to a method specified by ASTM (American Society for testing and Materials) Standard D3418-82 (DSC method), and may be measured in the same way with the above-described method of measurement regarding the styrene-acrylic resin (1).

<Method of Measuring Softening Point (Tsp)>

The softening point of the amorphous resin (2) may be measured in the same way with the above-described method of measurement regarding the styrene-acrylic resin (1).

Percentage of the content of the amorphous resin (2) which configures the domain, to the binder resin which configures the toner base particle, is preferably 5 to 70% by mass of the total binder resins, and more preferably 10 to 20% by mass.

By controlling the proportion of the content of the amorphous resin (2), to the binder resins in the toner, within the above-described ranges, the low-temperature fixability, the high temperature offset resistance, and the fixation separability are appropriately balanced.

<Method of Manufacturing Amorphous Resin (2)>

Method of manufacturing the above-described amorphous resin (2) contained in the toner base particle may be any of general schemes. Four representative methods are as follows.

(A) A method of forming a vinyl-based polymerized segment, by preliminarily polymerizing the polyester-based polymerized segment, reacting the obtained polyester-based polymerized segment with a bireactive monomer, and further with an aromatic vinyl monomer and a (meth)acrylic ester-based monomer for forming the vinyl-based polymerized segment. In other words, the aromatic vinyl monomer and the (meth)acrylic ester-based monomer for forming the vinyl-based polymerized segment are allowed to polymerize, under the presence of the bireactive monomer which has a group capable of reacting with a polybasic carboxylic acid monomer or a polyhydric alcohol monomer for forming the polyester-based polymerized segment and a polymerizable unsaturated group, and a unmodified polyester resin.

(B) A method of forming a polyester-based polymerized segment, by preliminarily polymerizing the vinyl-based polymerized segment, reacting the obtained vinyl-based polymerized segment with a bireactive monomer, and further with a polybasic carboxylic acid monomer and a polyhydric alcohol monomer for forming the polyester-based polymerized segment.

(C) A method of coupling the polyester-based polymerized segment and the vinyl-based polymerized segment, which are preliminarily polymerized, by reacting them with a bireactive monomer.

(D) A method of coupling both segments, by preliminarily polymerizing the polyester polymerized segment, reacting a polymerizable unsaturated group of the obtained polyester polymerized segment with a vinyl-based polymerizable monomer so as to proceed addition polymerization, or by reacting it with a vinyl group of the vinyl-based polymerized segment so as to proceed coupling.

In the present invention, the bireactive monomer is a monomer which has a group capable of reacting with a polybasic carboxylic acid monomer or a polyhydric alcohol monomer for forming the polyester polymerized segment of the amorphous resin (2), and a polymerizable unsaturated group.

According to detailed procedures of method (A), the vinyl-based polymerized segment may be formed at the terminal of the polyester polymerized segment, by implementing:

(1) a mixing step of mixing the unmodified polyester resin for forming the polyester polymerized segment, the aromatic vinyl monomer and the (meth)acrylate ester-based monomer, and the bireactive monomer; and (2) a polymerization step of polymerizing the aromatic vinyl monomer and the (meth)acrylate ester-based monomer, under the presence of the bireactive monomer and the unmodified polyester resin. In this process, a terminal hydroxyl group of the polyester polymerized segment and a carboxy group of the bireactive monomer react to form an ester bond, and a vinyl group of the bireactive monomer and a vinyl group of the aromatic vinyl monomer or the (meth) acrylic monomer combine to couple the vinyl-based polymerized segment. Among the synthetic methods, method (A) is most preferable.

According to this method, the vinyl-based polymerized segment may be added to the terminal of the chain-like polyester polymerized segment. Since the vinyl-based polymerized segment has affinity to the styrene-acrylic resin (1) which configures the matrix, so that the toner base particle with the domain-matrix structure is supposedly formed.

The mixing step (1) is preferably implemented under heating. The heating temperature is selected so as to allow the unmodified polyester resin, the aromatic vinyl monomer, the (meth)acrylate ester-based monomer and the bireactive monomer to mix. In order to obtain excellent mixing and to facilitate control of polymerization, the temperature is preferably set to 80 to 220° C. for example, more preferably 130 to 200° C., and furthermore preferably 150 to 180° C.

By controlling the percentage of the total content of the aromatic vinyl monomer and the (meth)acrylate ester-based monomer, to the total mass of the resin materials to be used, in the above described ranges, the affinity between the amorphous resin (2) which configures the domain and the styrene-acrylic resin (1) which configures the matrix is appropriately controlled, and this enables manufacturing of the toner base particle with the domain-matrix structure, characterized by the domain scattered in the matrix.

The relative ratio of the aromatic vinyl monomer and the (meth)acrylate ester-based monomer is preferably controlled so that the glass transition point (Tg), calculated by Fox equation (i) below, falls in the range from 35 to 80° C., and preferably from 40 to 60° C.

$$1/Tg=\Sigma(Wx/Tgx) \quad \text{Equation (i):}$$

(in the equation (i), Wx represents a mass fraction of monomer x, and Tgx represents a glass transition point of a homopolymer of monomer x).

Note that, in this specification, the bireactive monomer is not included in the calculation of glass transition point.

(Amount of Addition of Bireactive Monomer)

Among the unmodified polyester resin, the aromatic vinyl monomer, the (meth)acrylate ester-based monomer and the bireactive monomer, the proportion of amount of use of the bireactive monomer, per 100% by mass of the total of the resin components to be used, or the total mass of these four resins, is preferably 0.1 to 5.0% by mass or less, and more preferably 0.5 to 3.0% by mass.

(Bireactive Monomer)

The bireactive monomer for forming the vinyl-based polymerized segment may be any monomer having a group capable of reacting with a polybasic carboxylic acid monomer or a polyhydric alcohol monomer for forming the polyester polymerized segment, and a polymerizable unsaturated group. Specific examples include acrylic acid, methacrylic acid, fumaric acid, maleic acid and maleic anhydride. In the present invention, acrylic acid or methacrylic acid is preferably used as the bireactive monomer.

<Vinyl-Based Polymerized Segment>

The aromatic vinyl monomer and the (meth)acrylate ester-based monomer for forming the vinyl-based polymerized segment have an ethylenic unsaturated bond capable of participating in radical polymerization.

(Aromatic Vinyl Monomer and (Meth)Acrylate Ester-Based Monomer)

The aromatic vinyl monomer is exemplified by styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and derivatives of these compounds.

Each of these aromatic vinyl monomers may be used independently or, two or more species may be used in combination.

The (meth)acrylate ester-based monomer is exemplified by methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacryalte, 2-ethylhexyl methacrylate, ethyl β-hydroxyacrylate, propyl γ-aminoacrylate, stearyl methacrylate, dimethylaminoethyl methacrylate, and diethylaminoethyl methacrylate. Each of these (meth)acrylate ester-based monomers may be used independently, or two or more species may be used in combination.

As the aromatic vinyl monomer and the (meth)acrylate ester-based monomer for forming the vinyl-based polymerized segment, a large proportion of styrene or derivative thereof is preferably used, from the viewpoint of obtaining an excellent chargeability and image quality characteristic. More specifically, the amount of use of styrene or derivative thereof is preferably 50% by mass or more of the total monomer used for forming the styrene-acrylic polymerized segment (aromatic vinyl monomer and (meth)acrylate ester-based monomer).

(Polymerization Initiator)

In the step of polymerizing the aromatic vinyl monomer and the (meth)acrylate ester-based monomer, the polymerization is preferably proceeded under the presence of a radical polymerization initiator. While time of addition of the radical polymerization initiator is not specifically limited, it is preferably added after the mixing step, from the viewpoint of easiness of control of the radical polymerization.

Known various polymerization initiators may be preferably used for the polymerization initiator. Specific examples include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydro peroxide, tert-hydroperoxide pertriphenyl acetate, tert-butyl performate, tert-butyl peracetate, tert-butyl perbenzoate, tert-butyl perphenylacetate, tert-butyl permethoxyacetate, and tert-butyl per-N-(3-tolyl)palmitate; and azo compounds such as 2,2'-azobis(2-aminodipropane) hydrochloride, 2,2'-azobis-(2-aminodipropane) nitrate, 1,1'-azobis(sodium 1-methylbutyronitrile-3-sulfonate), 4,4'-azobis-4-cyanovalerate, and poly(tetraethylene glycol-2,2'-azobisisobutyrate). While the amount of addition of the polymerization initiator may vary depending on desired levels of molecular weight and molecular weight distribution, it is preferably 5 to 30% by mass of the polymerizable monomer.

(Chain Transfer Agent)

In the above-described step of polymerizing the aromatic vinyl monomer and the (meth)acrylate ester-based monomer, any of chain transfer agents having generally been used are usable, for the purpose of controlling the molecular weight of the styrene-acrylic polymerized segment. The chain transfer agent is exemplified by alkyl mercaptan, and mercapto fatty acid ester, without special limitation.

It is preferable to preliminarily mix the chain transfer agent with the resin forming material, in the mixing step described above.

While the amount of addition of the chain transfer agent may vary depending on desired levels of molecular weight or molecular weight distribution of the styrene-acrylic polymerized segment, it is preferably 0.1 to 5% by mass of the total amount of the aromatic vinyl monomer, the (meth)acrylate ester-based monomer, and the bireactive monomer.

While the polymerization temperature in the polymerization step of polymerizing the aromatic vinyl monomer and the (meth)acrylate ester-based monomer may vary depending on the polymerization method, it is appropriately selectable so long as the polymerization between the aromatic vinyl monomer and the (meth)acrylate ester-based monomer, and linking to the polyester resin can proceed, without special limitation. The polymerization temperature is preferably 80 to 220° C.

<Polyester-Based Polymerized Segment>

The amorphous polyester resin used for producing the polyester-based polymerized segment which configures the amorphous resin (2) in the present invention is manufactured by polycondensation reaction using the polybasic carboxylic acid monomer (derivative) and the polyhydric alcohol monomer (derivative) as source materials, under the presence of an appropriate catalyst.

The polybasic carboxylic acid monomer usable herein is exemplified by alkyl ester, acid anhydride and acid chloride of polybasic carboxylic acid monomer, and the polyhydric alcohol monomer usable herein is exemplified by ester compound of polyhydric alcohol monomer and hydroxycarboxylic acid.

The polybasic carboxylic acid monomer is exemplified by dibasic carboxylic acids such as oxalic acid, succinic acid, maleic acid, adipic acid, β-methyladipic acid, azelaic acid, sebacic acid, nonane dicarboxylic acid, decane dicarboxylic acid, undecane dicarboxylic acid, dodecane dicarboxylic acid, fumaric acid, citraconic acid, diglycolic acid, cyclohexane-3,5-dien-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenyl acetate, p-phenylene diacetate, m-phenylenediglycolic acid, p-phenylenediglycolic acid, o-phenylenediglycolic acid, diphenyl acetate, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and dodecenylsuccinic acid; and tribasic or higher basic carboxylic acids such as trimellitic acid, pyromellitic acid, naphthalenetricarboxylic acid, naphthalenetetracarboxylic acid, pyrenetricarboxylic acid, and pyrenetetracarboxylic acid.

As the polybasic carboxylic acid monomer, it is preferable to use an unsaturated aliphatic dicarboxylic acid such as fumaric acid, maleic acid, or mesaconic acid, and is particularly preferable to use an unsaturated aliphatic dicarboxylic acid such as represented by the formula (A) above. In the present invention, also an anhydride of dicarboxylic acid, such as maleic anhydride, may be used.

The polyhydric alcohol monomer is exemplified by dihydric alcohols such as ethylene glycol, propylene glycol, butanediol, diethylene glycol, hexanediol, cyclohexanediol, octanediol, decanediol, dodecanediol, ethylene oxide adduct of bisphenol A, and propylene oxide adduct of bisphenol A; and trihydric or higher hydric polyols such as glycerin, pentaerythritol, hexamethylolmelamine, hexaethylolmelamine, tetramethylol benzoguanamine, and tetraethylol benzoguanamine.

The polyester-based polymerized segment which configures the amorphous resin (2) in the present invention is preferably amorphous polyester. In order to form the amorphous polyester, the polybasic carboxylic acid and the polyhydric alcohol, used as the monomers, preferably contain no straight-chain alkyl group. As the polyhydric alcohol monomer, it is preferable to use dihydric alcohol having aromatic rings, such as ethylene oxide adduct of bisphenol A, and propylene oxide adduct of bisphenol A.

The ratio of the polybasic carboxylic acid monomer and the polyhydric alcohol monomer, in terms of equivalence ratio [OH]/[COOH], given by equivalence of hydroxyl group [OH] of polyhydric alcohol monomer, and equivalence of carboxy group [COOH] of the polybasic carboxylic acid, is preferably 1.5/1 to 1/1.5, and more preferably 1.2/1 to 1/1.2.

The catalyst used for synthesis of the polyester resin may be selectable from various species of known catalysts.

The amorphous polyester resin (polyester polymerized segment) for obtaining the amorphous resin (2) preferably has a glass transition point of 42 to 75° C., and more preferably 45 to 70° C. By setting the glass transition point of the amorphous polyester resin to 42° C. or higher, the polyester resin will have an appropriate level of cohesive power in high-temperature regions, and thereby the hot offset phenomenon in the fixing process will be suppressed. Also with the glass transition point of the amorphous polyester resin set to 75° C. or lower, a sufficient level of melting will be achieved in the fixing process, and thereby a sufficient level of lowest fixation temperature may be obtained.

The weight-average molecular weight (Mw) of the amorphous polyester resin preferably falls in the range from 1500 to 60000, and more preferably from 3000 to 40000.

By setting the weight-average molecular weight to 1500 or larger, a preferable level of cohesive power of the binder as a whole may be obtained, and the high temperature offset in the fixing process may be suppressed. Also with the weight-average molecular weight set to 60000 or smaller, a sufficient level of melt viscosity may be obtained, and a sufficient level of lowest fixation temperature may be achieved, thereby the high temperature offset in the fixing process may be suppressed.

The amorphous polyester resin may have a partially branched structure or crosslinked structure, by appropriately selecting the basicity of polybasic carboxylic acid monomer or hydricity of the polyhydric alcohol monomer to be used.

In the manufacture of the amorphous resin (2), the content of residual volatile organic substance derived from the emulsion, such as residual monomer remained after the polymerization process, is preferably suppressed to 1000 ppm or below, more preferably 500 ppm or below, and furthermore preferably 200 ppm or below, when in use.

The toner base particle of the present invention may be added with optional colorant, mold releasing agent, charge control agent, and so forth.

<Colorant>

Colorant used when the toner base particle is configured to contain it is arbitrarily selectable from carbon black, magnetic material, dye, pigment, and so forth.

Examples of the usable carbon black include channel black, furnace black, acetylene black, thermal black, and lamp black.

Examples of the usable magnetic material include ferromagnetics such as iron, nickel and cobalt, alloys containing these metals, and compounds of ferromagnetic metals such as ferrite and magnetite.

Example of the usable pigment include C. I. pigment red 2, ditto. 3, ditto. 5, ditto. 7, ditto. 15, ditto. 16, ditto. 48:1, ditto. 48:3, ditto. 53:1, ditto. 57:1, ditto. 81:4, ditto. 122, ditto. 123, ditto. 139, ditto. 144, ditto. 149, ditto. 166, ditto. 177, ditto. 178, ditto. 208, ditto. 209, ditto. 222, C. I. pigment orange 31, ditto. 43, C. I. pigment yellow 3, ditto. 9, ditto. 14, ditto. 17, ditto. 35, ditto. 36, ditto. 65, ditto. 74, ditto. 83, ditto. 93, ditto. 94, ditto. 98, ditto. 110, ditto. 111, ditto. 138, ditto. 139, ditto. 153, ditto. 155, ditto. 180, ditto. 181, ditto. 185, C. I. pigment green 7, C. I. pigment blue 15:3, ditto. 15:4, ditto. 60, phthalocyanine pigments with a center metal of zinc, titanium, magnesium or the like, and mixture of these compounds. Example of the usable dye include C. I. solvent red 1, ditto. 3, ditto. 14, ditto. 17, ditto. 18, ditto. 22, ditto. 23, ditto. 49, ditto. 51, ditto. 52, ditto. 58, ditto. 63, ditto. 87, ditto. 111, ditto. 122, ditto. 127, ditto. 128, ditto. 131, ditto. 145, ditto. 146, ditto. 149, ditto. 150, ditto. 151, ditto. 152, ditto. 153, ditto. 154, ditto. 155, ditto. 156, ditto. 157, ditto. 158, ditto. 176, ditto. 179, pyrazolotriazole azo dye, pyrazolotriazole azomethine dye, pyrazolone azo dye, pyrazolone azomethine dye, C. I. solvent yellow 19, ditto. 44, ditto. 77, ditto. 79, ditto. 81, ditto. 82, ditto. 93, ditto. 98, ditto. 103, ditto. 104, ditto. 112, ditto. 162, C. I. solvent blue 25, ditto. 36, ditto. 60, ditto. 70, ditto. 93, ditto. 95, and mixtures of these compounds.

The number-average primary particle size of the colorant is preferably 10 to 200 nm or around, although depending on species.

The proportion of the content of colorant, when the toner base particle is configured to contain the colorant, is preferably 1 to 30% by mass of the binder resin, and more preferably 2 to 20% by mass.

<Mold Releasing Agent>

The toner base particle of the present invention may be added with a mold releasing agent which is represented by wax. Examples of the wax include hydrocarbon-based wax such as low-molecular-weight polyethylene wax, low-molecular-weight polypropylene wax, Fischer-Tropsh wax, micro-crystalline wax, and paraffin wax; and ester-based wax such as carnauba wax, pentaerythritol beheante, pentaerythritol tetrastearate, behenyl behenate, and behenyl citrate. Each of these compounds may be used independently or, two or more species may be combined.

In the present invention, the wax is preferably pentaerythritol behenate ester or pentaerythritol tetrastarate ester, from the viewpoint of the HSP value.

The wax usable herein preferably has a melting point of 50 to 95° C., in view of ensuring the low-temperature fixability and mold releasability of the toner. The proportion of the content of the wax is preferably 2 to 20% by mass of the total amount of binder resins, more preferably 3 to 18% by mass, and furthermore preferably 4 to 15% by mass.

Existence form of the wax in the toner base particle is preferably a domain independent from that of the amorphous resin (2). By forming independent domains, the individual functions will be more likely to be expressed. For an exemplary case where the toner is produced in an aqueous medium, by producing the toner base particle in the state that the wax is covered with the resin, the domain different from that of the amorphous resin is likely to be formed. By the effect of existence of the amorphous resin (2) and the wax as a mold releasing agent, respectively in the form of independent domains in the matrix, without being compatible with each other, the amorphous resin (2) and the wax can fully express functions of their own, and thereby the toner will have excellent low-temperature fixability, fixation separability and the offset resistance on the rough paper.

The diameter of the wax domain is preferably 300 nm to 2 μm. In this range, a sufficient level of mold releasability may be obtained.

<Charge Control Agent>

For the toner base particle of the present invention, various known species of charge control agent may be used.

Known various species of charge control agent, which are dispersible in the aqueous medium, may be used. Specific examples include nigrosin-based dye, metal salts of naphthenic acid or higher fatty acid, alkoxylated amine, quaternary ammonium salt compound, azo-based metal complex, and metal salicylate or metal complex thereof.

The proportion of the content of the charge control agent is preferably 0.1 to 10% by mass of the total amount of binder resin, and more preferably 0.5 to 5% by mass.

<<Explanation of Toner Particle>>

While the toner base particle in the present invention is usable in its intact form as the toner particle, it is generally preferable to use it after being added with an external additive. In the present invention, the "toner base particle" added with the external additive will be referred to as "toner particle". The "toner" means an assemblage of the "toner particle".

(Average Roundness of Toner Base Particle)

Average roundness of the toner base particle used in the present invention will be explained. The toner particle used in the present invention preferably has an average roundness of 0.850 or larger and 0.990 or smaller.

The average roundness of the toner base particle is measured using a flow-type particle imaging instrument "FPIA-2100" (from Sysmex Corporation).

Specifically, the toner base particle is swelled in an aqueous surfactant solution, dispersed by sonication for one minute, and then measurement is performed using "FPIA-2100", in an HPF (high power field) mode, while controlling the concentration to an appropriate range of 3000 to 10000 in terms of HPF count. In this range, the measured values are reproducible. The roundness is calculated by the equation below.

Roundness=(Circumferential length of circle having same projected area with particle image)/(Circumferential length of projected particle image)

The average roundness is an arithmetic mean, obtained by summing up the roundness of the individual particles, and by dividing the sum by the number of measured particles.

(Diameter of Toner Particle)

Next, the particle size of the toner particle used in the present invention will be explained. The particle size of the toner particle used in the present invention is preferably 3 μm or larger and 10 μm or smaller, in terms of volume-average particle size ($D_{50}$%), or volume-based median diameter.

By controlling the volume-based median diameter within the above-described range, it now becomes possible to truly reproduce extremely fine dots with a resolution of 1200 dpi (dpi=dots per inch (2.54 cm)) or around.

The volume-based median diameter ($D_{50}$%) of the toner particle may be measured and calculated as described above, typically by using a system configured by Coulter counter "Multisizer 3" (from Beckman Coulter, Inc.), connected with a computer system (from Beckman Coulter, Inc.) installed with a data processing software "Software V3.51".

In the measurement, 0.02 g of toner particle is wetted with 20 ml of a surfactant solution (aimed at dispersing the toner particle, produced typically by diluting a neutral detergent containing a surfactant component 10 fold with pure water), and dispersed by sonication for one minute, to produce a toner particle dispersion. The toner particle dispersion is dispensed by pipetting to a beaker which contains Isoton II (from Beckman Coulter, Inc.) set on a sample stand, so as to adjust the measurement concentration to 5 to 10%, and the dispersion is measured with a measuring instrument set to a count level of 25000. The aperture of Multisizer 3 used herein is 100 μm. The measurement range from 2 to 60 μm is divided into 256 sections to find the frequency value in each section, and a particle size (volume-based median diameter) which falls on the 50% point of a volume-based cumulative fraction, from the maximum particle size, is defined as the volume-based median diameter ($D_{50}$%).

Also the particle size of the toner base particle may be measured in the same way.

(Softening Point of Toner)

The softening point of the toner of the present invention is preferably 90 to 120° C. By controlling the softening point of the toner in this range, a preferable level of low-temperature fixability may be obtained.

The softening point may be measured by the method described above, namely, using Flow Tester "CFT-500D" (from Shimadzu Corporation).

<<Method of Manufacturing Toner>>

<Method of Manufacturing Toner Base Particle>

Methods of manufacturing the toner base particle of the present invention are exemplified by suspension polymerization, emulsion flocculation and other known methods, wherein emulsion flocculation is preferable. According to the emulsion flocculation, the toner particle is downsized easily, which is advantageous from the viewpoint of cost and stability of manufacturing.

The emulsion flocculation is a method of manufacturing the toner particle, by which a dispersion of a binder resin particle manufactured by emulsification (also referred to as "binder resin particle", hereinafter) is mixed, if necessary, with a dispersion of a colorant particle (referred to as "colorant fine particle", hereinafter), the mixture is allowed to flocculate until a desired diameter of toner particle is achieved, and the binder resin particles are further allowed to fuse for shape control. The binder resin particle may contain the mold releasing agent, the charge control agent or the like.

The toner base particle of the present invention is preferably manufactured by emulsion flocculation. More specifically, an aqueous dispersion of fine particle of the styrene-acrylic resin (1), an aqueous dispersion of fine particle of the amorphous resin (2) and an aqueous dispersion of the colorant fine particle may be mixed, and the individual fine particles are allowed to flocculate and then fuse, to thereby obtain the toner base particle with the domain-matrix structure.

An exemplary process of manufacturing the toner base particle of the present invention, intended to contain the colorant, specifically includes:

(a) A step of preparing a dispersion of fine particle of the styrene-acrylic resin (1) in an aqueous medium, that is, a step of preparing an aqueous dispersion of the resin fine particle having dispersed therein the fine particles of the styrene-acrylic resin (1) formed by polymerization in an aqueous medium;

(b) A step of preparing a dispersion of fine particles of the amorphous resin in an aqueous medium;

(c) A step of preparing a dispersion of a colorant fine particles in an aqueous medium;

(d) A step of ripening, in which the dispersion of the fine particles of the styrene-acrylic resin (1), the dispersion of the fine particles of the amorphous resin (2) and the dispersion of the colorant fine particles are mixed, so as to allow the fine particles of the styrene-acrylic resin (1), the fine particles of the amorphous resin (2) and the colorant fine particles to flocculate, and then fused and ripened under heat energy. The toner base particle is thus formed.

The styrene-acrylic resin fine particle in the step (a) may have a multi-layered structure of two or more layers composed of binder resins having different compositions. The binder resin particle thus configured, typically having a double-layered structure, may be obtained for example by preparing a dispersion of resin particles according to a generally-known emulsion polymerization process (first-stage polymerization), adding a polymerization initiator and a polymerizable monomer to the dispersion, and allowing the system to polymerize (second-stage polymerization). Also a three-layered structure may be obtained by optionally adding a polymerizable monomer to the system, and then subjecting the system to a third-stage polymerization.

For the manufacturing of the toner base particle, the step (d) may be followed by a washing step in which the toner base particles are filtered off from the aqueous dispersion of the toner base particles, and the surfactant or the like is removed from the toner base particle; and a drying step in which the thus-washed toner base particles are dried; and may further optionally be followed by an external additive addition step in which the an external additive is added to the thus-processed toner base particle.

In the present invention, the "aqueous medium" means a medium composed of 50 to 100% by mass of water, and 0 to 50% by mass of water-soluble organic solvent. The water-soluble organic solvent is exemplified by methanol, ethanol, isopropanol, butanol, acetone, methyl ethyl ketone, and tetrahydrofuran. Alcoholic organic solvent unlikely to dissolve the resultant resin is preferable.

(Step of Preparing Dispersion of Fine Particles of Styrene-Acrylic Resin (1))

The dispersion of fine particles of the styrene-acrylic resin (1) may be prepared by emulsion polymerization.

When a surfactant is used in the process of polymerization of the styrene-acrylic resin (1), any of the surfactants exemplified above is usable.

The toner base particle of the present invention may contain, as the binder resin, the styrene-acrylic resin (1) and the amorphous resin (2), and if necessary, an internal additive such as colorant, mold releasing agent, charge control agent, magnetic powder or the like. Such internal additive may be introduced into the toner particle, typically by preliminarily dissolving or dispersing it in a monomer solution for forming the styrene-acrylic resin (1), in the process of polymerizing the styrene-acrylic resin (1).

Alternatively, such internal additive may be introduced into the toner particle, by preparing a separate dispersion of internal additive fine particles solely containing the internal additive, and then in the step of forming the toner base particle, by allowing the internal additive fine particles to flocculate together with the resin fine particles and the colorant fine particles. It is, however, more preferable to use the method based on the preliminary addition.

The average particle size of the fine particles of the styrene-acrylic resin (1) obtained in such process of polymerizing the styrene-acrylic resin (1) preferably falls in the range from 50 to 500 nm in terms of volume-based median diameter.

The volume-based median diameter is measured by using "UPA-150" (from Nikkiso Co., Ltd.).

(Step of Preparing Dispersion of Fine Particles of Amorphous Resin (2))

Method of preparing the dispersion of fine particles of the amorphous resin (2), usable in the present invention, may be any of methods selected from a method of mechanically crushing the resin and then dispersing it in an aqueous medium with the aid of a surfactant; a method of pouring an organic solvent solution of the amorphous resin (2) into an aqueous medium to thereby prepare a dispersion in the aqueous medium; a method of mixing a molten amorphous resin (2) with an aqueous medium, and then mechanically dispersing the mixture to prepare a dispersion in the aqueous medium; and phase inversion emulsification.

The average particle size of the fine particle of the amorphous resin (2) obtained in the process of preparing the dispersion of the amorphous resin (2) preferably falls in the range, for example, from 50 to 400 nm in terms of volume-based median diameter.

The surfactant may be any of those described above.

(Step of Preparing Dispersion of Colorant Fine Particles)

The dispersion of colorant fine particles may be obtained by dispersing the colorant into the aqueous medium. From the viewpoint of uniform dispersion of colorant, the surfactant concentration in the aqueous medium is preferably kept not lower than the critical micellar concentration (CMC). Disperser usable for dispersing the colorant may be any of various known dispersing apparatuses.

The surfactant usable herein may be any of those described previously.

The diameter of the colorant fine particle in the dispersion of the colorant fine particle, obtained in the step of preparing the dispersion of the colorant fine particles, preferably falls in the range from 10 to 300 nm in terms of volume-based median diameter.

The volume-based median diameter of the colorant fine particle in the dispersion of the colorant fine particle is measured using an electrophoretic light scattering photometer "ELS-800" (from Otsuka Electronics Co., Ltd.).

(Step of Forming Toner Base Particle)

In the step forming the toner base particle, besides the fine particle of the styrene-acrylic resin (1), the fine particle of the amorphous resin (2) and the colorant fine particle, any other toner components such as anti-offset agent such as wax, and charge control agent may be flocculated together, if necessary.

A specific method of flocculating and fusing the fine particle of the styrene-acrylic resin (1), the fine particle of the amorphous resin (2) and the colorant fine particle, is such as adding a flocculant into an aqueous medium so as to adjust the concentration thereof at the critical flocculation concentration or above; heating the mixture at a temperature not lower than the glass transition point of the resin fine particles and not higher than the melting peak temperature of the mixture, so as to proceed salting-out of the fine particles of the styrene-acrylic resin (1), the amorphous resin (2) and the colorant, and to concurrently fuse them; adding a deflocculating agent to terminate the particle growth when a desired particle size is attained; and optionally continuing heating of the mixture for shape control of the particles.

In this method, it is preferable to heat the mixture up to a temperature not lower than the glass transition point of the resin fine particles and not higher than the melting peak temperature of the mixture, while minimizing the time the mixture is allowed to stand after addition of the flocculant. Although the reason why remains unclear, it is supposedly because the state of flocculation of the particles may vary depending on the time the mixture is allowed to stand after the salting-out, with possible risks of destabilizing the particle size distribution, and modifying the surface property of the fused particles. The time before the temperature elevation is preferably within 30 minutes in general, and more preferably 10 minutes. The rate of temperature elevation is preferably 1° C./min or faster. From the viewpoint of suppressing coarse particles from generating due to rapid progress of fusion, the upper limit of the rate of temperature elevation is preferably 15° C./min or below, although not specifically limited thereto. It is critical to allow the fusion to proceed by keeping the temperature of the reaction system for a predetermined time, even after the reaction system reached a temperature not lower than the glass transition point. In this way, the growth and fusion of the toner base particles are allowed to proceed concurrently in an efficient manner, and this improves the durability of the finally obtained toner particles.

In the present invention, in this step of flocculation, the number-average diameter of the domain of the amorphous resin (2) is adjustable in the range from 150 to 1000 nm, by mixing the styrene-acrylic resin (1) and the amorphous resin (2) before the heating is started, and by allowing them to flocculate at the same time. Eighty percent by volume or more of the domain may be localized in the near-the-surface range of the toner base particle, by adjusting the HSP distance between the styrene-acrylic resin (1) which configures the matrix and the amorphous resin (2) which configures the domain, in the range from 5.0 to 8.0 $(J/cm^3)^{1/2}$.

(Flocculant)

The Flocculant used in the step of forming toner base particle is preferably selectable from metal salts, without special limitation. The metal salts are exemplified by salts of monovalent metal such as alkali metal including sodium, potassium and lithium; salts of divalent metal such as calcium, magnesium, manganese and copper; and salts of trivalent metal salt such as iron and aluminum. Specific examples of the metal salts include sodium chloride, potassium chloride, lithium chloride, calcium chloride, magnesium chloride, zinc chloride, copper sulfate, magnesium sulfate and manganese sulfate. Among them, salts of divalent metal are particularly preferable, since they can proceed the flocculation only with a smaller amount. Each of these salts may be used independently or, two or more species may be used in combination.

The toner base particle obtained in the step of forming toner base particle preferably falls in the range, for example, from 2 to 9 μm in terms of volume-based median diameter ($D_{50}$%), and more preferably from 4 to 7 μm.

The volume-based median diameter of the toner base particle is measured using a coulter counter "Multisizer 3" (from Beckman Coulter, Inc.).

(Ripening Step)

While the shape of the toner particle in the toner may be equalized to a certain degree by controlling the heating temperature in the step of forming toner base particle, the step is further preferably followed by the ripening step for further equalization of shape.

The ripening step is directed to control the toner base particles, already having formed to have the constant particle sizes and to distribute in a narrow range of particle size, so as to have further smooth surfaces and uniform shapes, through control of temperature and time of heating. Specifically, in the step of forming toner base particle, the heating temperature is set lower so as to promote the equalization, while suppressing fusion among the resin fine particles, and also in the step of ripening, the heating temperature is again set lower and the heating time is set longer, to attain a desired level of average roundness of the toner base particles, that is, to attain the uniform surface profiles.

(Washing Step, Drying Step)

The washing step and the drying step may be conducted according to any of known various methods. More specifically, after the ripening up to a desired level of average roundness attained in the ripening step, the mixture is subjected to solid-liquid separation by a known method such as using a centrifuge and then washed, the particles are dried under reduced pressure to remove the organic solvent, and further dried in a known dryer such as flash jet drier or fluidized bed dryer, so as to remove the moisture and a trace amount of organic solvent. The drying temperature is successfully set so as not to fuse the toner.

(Step of Adding External Additive)

The step of adding external additive is a step of preparing the toner particle, by adding an optional external additive to the dried toner base particle, followed by mixing.

The toner base particle, having been produced after going through the processes up to the drying step, may be used as the toner particle without modification. It is however preferable, from the viewpoint of improving the charging performance, fluidity, and cleaning performance when used as the toner, to add any of known particles such as inorganic fine particle and organic fine particle, or lubricant, as the external additive to the surface.

Various species of external additives may be used in a combined manner.

The inorganic fine particle is exemplified by inorganic oxide fine particles such as silica fine particle, alumina fine particle and titanium oxide fine particle; metal stearate compound fine particles such as aluminum stearate fine particle and zinc stearate fine particle; and inorganic titanate compound fine particles such as strontium titanate fine particle and zinc titanate fine particle.

These inorganic fine particles are preferably treated on the surface thereof with silane coupling agent, titanium coupling agent, higher fatty acid or silicone oil, from the viewpoint of heat-resistant storability and environmental stability.

The amount of addition of the external additive is preferably 0.05 to 5 parts by mass per 100 parts by mass of toner base particle, and preferably 0.1 to 3 parts by mass.

Method of adding the external additive is exemplified by a dry process, by which the dried toner base particle is added with the external additive in a powdery form. Mixing apparatus is exemplified by mechanical mixing apparatus such as Henschel mixer and coffee mill.

<Developer>

The toner of the present invention may be used as a magnetic or nonmagnetic single-component developer, or may be used as a two-component developer after mixed with a carrier.

The carrier usable herein is a magnetic particle composed of any of known materials which include metal such as iron, alloy such as ferrite, oxide such as magnetite, and these substances further alloyed with metal such as aluminum or lead. Among them, ferrite particle is preferably used. Also a coated carrier having a coating of resin or the like on the surface of the magnetic particle, or a resin-dispersed carrier having the magnetic fine powder dispersed in a binder resin, may be used as the carrier.

The carrier preferably has a volume-average particle size of 15 to 100 μm, and more preferably 25 to 80 μm.

According to the above embodiments, it now becomes possible to provide an electrostatic latent image developing toner which is excellent in low-temperature fixability and fixation separability, and is capable of yielding a toner image with an excellent high temperature offset resistance even on a rough paper having a large surface irregularity.

While an expression mechanism or operation mechanism of the effect of the present invention still remains unclear, the present inventors surmise it as follows.

In the toner of the present invention, the toner base particle is configured by using the "styrene-acrylic resin (1)" with an excellent high temperature offset resistance as a matrix, and by using the "amorphous resin (2) which is formed by combining a vinyl-based polymerized segment and a polyester-based resin" (also simply referred to as "amorphous resin (2)", hereinafter) with an excellent low-temperature fixability as a domain. The "matrix" also serves as a medium (base) which contains and holds the "domain", and the "domain" resides as isolated micro-regions in the matrix, maintained in the state of phase separation without being solubilized. The domain-matrix structure is thus established, allowing the individual resins to exhibit their intrinsic performances.

The domain-matrix structure in the context of the present invention is also known as a sea-island structure. The sea-island structure is configured by, as illustrated in FIGURE, an island-like phase (domain 3) having a closed interface (boundary between the phases), which resides in a continuous phase (the continuous phase corresponds to the matrix 2, assimilating the "sea") of the toner base particle 1. In other words, the domain-matrix structure is referred to as a higher-order structure of mixture obtained when a plurality of (two, for example) incompatible resin components are mixed, in which, in the continuous phase (sea) composed of one of the resin components, the other resin component is scattered in the form of island or particle. In short, this is a structure in which one resin configures the continuous phase (sea) which corresponds to the matrix, and the other configures the island-like isolated phase (scattered phase) which corresponds to the domain.

In the present invention, the toner base particle contains at least a binder resin, and has the domain-matrix structure. In this configuration, the matrix contains the styrene-acrylic resin (1), and the domain contains the amorphous resin (2) which is formed by combining the vinyl-based polymerized segment and the polyester-based polymerized segment.

The styrene-acrylic resin (1) which configures the matrix is a resin characterized by a high elasticity at high temperatures, and contributes to the fixation separability and high temperature offset resistance. On the other hand, polyester is characterized by sharp-melting performance as compared with the styrene-acrylic resin, while keeping a high glass transition point (Tg). As a result of such high glass transition point, prominent effects of the heat-resistant storability and fixation separability may be obtained. Moreover, the sharp-melting performance contributes to an excellent low-temperature fixability. It is supposed that, by combining the polyester and vinyl-based polymers to configure the amorphous resin (2) in which the polyvinyl-based polymerized segment and the polyester-based polymerized segment are combined, the amorphous resin (2) is now given an excellent affinity with the styrene-acrylic resin (1) which forms the matrix while keeping the above characteristics inherent to polyester, and thereby an excellent domain-matrix structure is formed.

In this configuration, the polyester is supposed to effectively exhibit the sharp-melting performance, since the amorphous resin (2) resides as the domain in the matrix, and resides in the near-the-surface range of the toner base particle. While in some conventional toner having the core-shell structure, the expression of the core characteristics has occasionally been influenced by the existence of the shell. In contrast, by employing the domain-matrix structure, both of the styrene-acrylic resin (1) which configures the matrix, and the amorphous resin (2) which configures the domain can reside in the near-the-surface range of the toner particle, so that both resins are supposed to fully express the individual characteristics in the fixing process.

It is also supposed that, by limiting the diameter of the domain configured by the amorphous resin (2) to 150 to 1000 nm, mobility of the mold releasing agent is controlled, and thereby the fixation separability may be improved. More specifically, it is supposed that the smaller the total area of the interface between the styrene-acrylic resin (1) which configures the matrix and the amorphous resin (2) which configures the domain, the lesser the thermal mobility of the mold releasing agent will be inhibited, so that the location of the mold releasing agent contained inside the toner particle and dischargeability of the mold releasing agent in the molten state is controllable by the domain diameter, and thereby the characteristics of the mold releasing agent may fully be expressed in the fixing process.

On a rough paper with a large surface irregularity, the toner transferred onto projections would excessively be fed with heat energy when the toner transferred into recesses of the paper is fixed. The high temperature offset is therefore likely to occur at the projections. In contrast, in the present invention, by employing the domain-matrix structure, the styrene-acrylic resin (1) which configures the matrix can reside also on the surface of the toner base particle, so that the effect of highly elastic styrene-acrylic resin (1) may fully be expressed also in the toner transferred onto the projections, thereby the high temperature offset is supposedly suppressed.

EXAMPLES

The present invention will now be detailed referring to the attached drawings, without limiting the present invention.

<<Manufacture of Toner 1>>

<Preparation of Dispersion of Resin Fine Particles for Producing Toner>

<Preparation of Dispersion (A1) of Fine Particles of Styrene-Acrylic Resin (1)>

1. First-Stage Polymerization (Preparation of Dispersion of "Resin Fine Particles (a1)")

In a reaction vessel equipped with a stirrer, a temperature sensor, a temperature controller, cooling tube and a nitrogen gas feeding pipe, placed was an anionic surfactant solution prepared by preliminarily dissolving 2.0 parts by mass of "sodium lauryl sulfate" as an anionic surfactant into 2900 parts by mass of deionized water, and the inner temperature was elevated to 80° C. under a nitrogen gas flow and under stirring at 230 rpm.

To the surfactant solution, 9.0 parts by mass of "potassium persulfate (KPS)" as a polymerization initiator was added, the inner temperature was elevated to 78° C., and then a monomer solution (1) having the composition below:

Monomer Solution (1)

| | |
|---|---|
| Styrene | 540 parts by mass; |
| n-Butyl acrylate | 270 parts by mass; |
| Methacrylic acid | 65 parts by mass; and |
| n-Octylmercaptan | 17 parts by mass, |

was added dropwisely over 3 hours. After completion of the dropping, the content was stirred under heating at 78° C. for one hour so as to proceed polymerization (first-stage polymerization) to thereby prepare a dispersion of "resin fine particles (a1)".

2. Second-Stage Polymerization: Formation of Intermediate Layer (Preparation of Dispersion of "Resin Fine Particles (a11)")

In a flask equipped with a stirrer, a monomer solution having the composition below:

Monomer Solution

| | |
|---|---|
| Styrene | 94 parts by mass; |
| n-Butyl acrylate | 60 parts by mass; |
| Methacrylic acid | 11 parts by mass; and |
| n-Octylmercaptan | 5 parts by mass, |

was placed. The monomer solution was then added with 51 parts by mass of pentaerythritol tetrastearate ester (m.p.=75° C., HSP value=17.6 $(J/cm^3)^{1/2}$) as a mold releasing agent, and the content was dissolved under heating at 85° C., to thereby prepare a monomer solution (2).

Meanwhile, a surfactant solution obtained by dissolving 2 parts by mass of "sodium lauryl sulfate" as an anionic surfactant into 1100 parts by mass of deionized water was heated to 90° C. To the surfactant solution, the dispersion of "resin fine particles (a1)" was added so that 28 parts by mass, in terms of solid content, of the "resin fine particles (a1)" may be contained, the monomer solution (2) was then mixed and dispersed for 4 hours, in a mechanical disperser "Clearmix" (from M Technique Co., Ltd.) with a circulation path, to prepare a dispersion which contains emulsified particles each having a dispersed particle size of 350 nm. To the dispersion, an aqueous initiator solution prepared by dissolving 2.5 parts by mass of polymerization initiator "KPS" into 110 parts by mass of deionized water was added, and the system was stirred for 2 hours under heating at 90° C. for polymerization (second-stage polymerization), to thereby prepare a dispersion of "resin fine particles (a11)".

3. Third-Stage Polymerization: Formation of Outer Shell (Preparation of "Dispersion of Styrene-Acrylic Resin (1) Fine Particles (A1)")

To the dispersion of "resin fine particles (a11)", an aqueous initiator solution prepared by dissolving 2.5 parts by mass of polymerization initiator "KPS" into 110 parts by mass of deionized water was added, and then a monomer solution (3) having the composition below:

Monomer Solution (3)

| | |
|---|---|
| Styrene | 230 parts by mass; |
| n-Butyl acrylate | 100 parts by mass; and |
| n-Octylmercaptan | 5.2 parts by mass, |

was added dropwisely over one hour at 80° C. After completion of the dropwise addition, the content was stirred under heating for 3 hours, so as to proceed polymerization (third-stage polymerization). The content was then cooled down to 28° C., to thereby prepare a "dispersion (A1) of fine particles of styrene-acrylic fine resin (1)" (resin fine particles (A1) for forming the matrix) having fine particles of the styrene-acrylic resin (A1) dispersed in the anionic surfactant solution.

The styrene-acrylic resin (A1) was found to have a glass transition point of 51.5° C., a softening point of 105.7° C., and an HSP value of 17.5 $(J/cm^3)^{1/2}$.

<Preparation of Dispersion [B] of Fine Particles of Amorphous Resin (2)>

(1. Synthesis of "Amorphous Resin (2) [B1]")

In a reaction vessel equipped with a nitrogen gas feeding pipe, a dewatering pipe, a stirrer, and a thermocouple, placed were:

| | |
|---|---|
| 2-Mol propylene oxide adduct of bisphenol A | 500 parts by mass; |
| Terephthalic acid | 117 parts by mass; |
| Fumaric acid | 82 parts by mass; and |
| Esterification catalyst (tin octoate) | 2 parts by mass. |

The content was allowed to proceed a polycondensation reaction at 230° C. for 8 hours, and then cooled, to obtain a comparative "amorphous resin (2) [B1]" composed of polyester resin only.

(2. Synthesis of "Amorphous Resin (2) [B2]")

In a reaction vessel equipped with a nitrogen gas feeding pipe, a dewatering pipe, a stirrer, and a thermocouple, placed were:

| | |
|---|---|
| 2-Mol propylene oxide adduct of bisphenol A | 500 parts by mass; |
| Terephthalic acid | 250 parts by mass; |
| Fumaric acid | 10 parts by mass; and |
| Esterification catalyst (tin octoate) | 2 parts by mass. |

The content was allowed to proceed polycondensation reaction at 230° C. for 8 hours, further allowed to react at 8 kPa for one hour, cooled down to 160° C., and then a mixture containing:

| | |
|---|---|
| Acrylic acid | 10 parts by mass; |
| Styrene | 25 parts by mass; |
| n-Butyl acrylate | 5 parts by mass; and |
| Polymerization initiator (di-t-butyl peroxide) | 10 parts by mass, |

was added dropwisely through a dropping funnel over one hour. After the dropwise addition, the content kept at 160° C. was allowed to proceed the addition polymerization reaction for one hour, heated to 200° C., and kept at 10 kPa for one hour. Acrylic acid, styrene and butyl acrylate were then removed, to thereby obtain an "amorphous resin (2) [B2]" configured by the vinyl-based polymerized segment and the polyester polymerized segment combined with each other.

(3. Synthesis of "Amorphous Resins (2) [B3]-[B6]")

"Amorphous resin (2) [B3]", "amorphous resin (2) [B4]", "amorphous resin (2) [B5]" and "amorphous resin (2) [B6]", all having therein the vinyl-based polymerized segment and the polyester polymerized segment combined with each other, were obtained in the same way. Resin composition, HSP value, glass transition point and softening point of these amorphous resins (2) were summarized in Table 1.

TABLE 1

| | POLYESTER POLYMERIZED SEGMENT | | | | | | |
|---|---|---|---|---|---|---|---|
| | | | POLYBASIC CARBOXYLIC ACID MONOMER | | | | |
| | | | SATURATED DICARBOXYLIC ACID | | UNSATURATED ALIPHATIC DICARBOXYLIC ACID | | BIREACTIVE MONOMER |
| AMORPHOUS | POLYHYDRIC ALCOHOL MONOMER | | TEREPHTHALIC ACID [PARTS BY | | FUMARIC ACID [PARTS BY | | ACRYLIC ACID [PARTS BY |
| RESIN (2) | *1 | [mol] | MASS] | [mol] | MASS] | [mol] | MASS] |
| B1 | 500 | 1.45 | 117 | 0.70 | 82 | 0.71 | — |
| B2 | 500 | 1.45 | 250 | 1.51 | 10 | 0.09 | 10 |
| B3 | 500 | 1.45 | 90 | 0.54 | 170 | 1.46 | 10 |
| B4 | 500 | 1.45 | 54 | 0.33 | 150 | 1.29 | 10 |
| B5 | 500 | 1.45 | 117 | 0.70 | 82 | 0.71 | 10 |
| B6 | 500 | 1.45 | 50 | 0.30 | 150 | 1.29 | 10 |

TABLE 1-continued

| AMORPHOUS RESIN (2) | VINYL-BASED POLYMERIZED SEGMENT: AROMATIC VINYL MONOMER STYRENE [PARTS BY MASS] | VINYL-BASED POLYMERIZED SEGMENT: (METH)ACYLATE ESTER-BASED MONOMER BUTYL ACRYLATE [PARTS BY MASS] | *2 | *3 | GLASS TRANSITION POINT [° C.] | SOFTENING POINT [° C.] |
|---|---|---|---|---|---|---|
| B1 | — | — | 0 | 21.5 | 58.9 | 97.1 |
| B2 | 25 | 5 | 5.0 | 22.0 | 59.5 | 90.7 |
| B3 | 25 | 5 | 5.0 | 20.8 | 54.2 | 93.3 |
| B4 | 58 | 10 | 10.0 | 20.6 | 47.6 | 85.1 |
| B5 | 140 | 25 | 20.0 | 20.7 | 54.5 | 87.4 |
| B6 | 235 | 55 | 30.0 | 20.3 | 45.1 | 85.3 |

*1: BISPHENOL A-PROPYLENE OXIDE [PARTS BY MASS]
*2: CONTENT PROPORTION OF VINVL-BASED POLYMERIZED SEGMENT [% BY MASS]
*3: HSP VALUE OF AMORPHOUS RESIN (2) [$(J/cm^3)^{1/2}$]

(3. Preparation of Dispersions [B1]-[B6] of Fine Particles of Amorphous Resins (2))

One hundred parts by mass of the thus-obtained amorphous resin (2) [B1], composed of the polyester resin only, was crushed using a crusher "Roundel Mill Model RM-2" (from Tokuju Corporation), mixed with 638 parts by mass of a preliminarily-prepared 0.26% by mass solution of sodium lauryl sulfate, the content was kept stirred and sonicated using a ultrasonic homogenizer "US-150T" (from NISSEI Corporation), at a vibration level of 300 μA for 30 minutes, to thereby obtain a "dispersion [B1] of fine particles of amorphous resin (2)" having dispersed therein the "amorphous resin fine particle (2) [B1]" with a volume-based median diameter ($D_{50}$%) of 200 nm.

"Dispersions [B2], [B3], [B4], [B5] and [B6] of fine particles of amorphous fine resins (2)" were prepared in the same way.

<Preparation of Dispersion of Fine Particles of Colorant Particle (C)>

Ninety parts by mass of dodecyl sodium sulfate was dissolved in 1600 parts by mass of deionized water. The solution was kept stirred, and then gradually added with 420 parts by mass of carbon black "Mogul L" (from Cabot Corporation), and the content was then dispersed in a stirrer "Clearmix" (from M Technique Co., Ltd.), to thereby prepare a dispersion of colorant fine particles (C) having the colorant fine particles dispersed therein. Particle size of the dispersion, measured using a Microtrac particle size distribution analyzer "UPA-150" (from Nikkiso Co., Ltd.), was found to be 117 nm.

<Manufacture of Toner 1>

(Flocculating and Fusing Step)

Into a reaction vessel equipped with a stirrer, a temperature sensor, and a condenser tube, placed were 444 parts by mass, in terms of solid content, of the "dispersion (A1) of fine particles of styrene-acrylic resin (1)" as the dispersion of resin fine particles for forming the matrix, and 21 parts by mass, in terms of solid content, of the "dispersion [B3] of fine particles of amorphous resin (2)" as the dispersion of resin fine particles for forming the domain, and 1600 parts by mass of deionized water. The content was further added with a 5 mol/L aqueous sodium hydroxide solution so as to be adjusted to pH 10, and the liquid temperature was adjusted to 20° C.

Thereafter, 35 parts by mass, in terms of solid content, of the "dispersion (C) of colorant fine particles" was added. Next, an aqueous solution obtained by dissolving 75 parts by mass of magnesium chloride into 75 parts by mass of deionized water was added under stirring, at 30° C. and over 10 minutes. The content was allowed to stand for 3 minutes, and then heated up to 80° C. and over 60 minutes, and kept at 80° C. so as to proceed the particle growth. In this state, the particle size of associated particle was measured using "Multisizer 3" (from Beckman Coulter, Inc.), and when the volume-based median diameter ($D_{50}$%) reached 6.7 μm, the particle growth was terminated by adding an aqueous solution prepared by dissolving 125 parts by mass of sodium chloride into 500 parts by mass of deionized water. The content was further heated, and kept at 90° C. under stirring, so as to allow the particles to fuse. The average roundness was measured using a flow-type particle imaging instrument "FPIA-2100" (from Sysmex Corporation) (HPF count=4000), and when the average roundness reached 0.945, the content was cooled down to 30° C., to thereby obtain "dispersion of toner base particles [1]".

(Washing and Drying Step)

The "dispersion of toner base particle [1]" prepared in the "Flocculating and Fusing Step" was subjected to solid-liquid separation using a centrifuge to remove coarse particle and micro-particle, to thereby form a wet cake of the toner base particles. The wet cake was washed in a centrifuge using deionized water at 35° C., until the electrical conductivity of the filtrate becomes 5 μS/cm, and then transferred to a "flash jet dryer" (from Seishin Enterprise Co., Ltd.), and dried until the moisture content falls down to 0.5% by mass, to thereby obtain "toner base particles [1]".

(Step of External Additive Treatment)

The "toner base particle [1]" was added with 2.5% by mass of hydrophobic silica (number-average primary particle size=120 nm), 1.0% by mass of hydrophobic silica (number-average primary particle size=12 nm), and 0.6% by mass of hydrophobic titania (number-average primary particle size=20 nm), and the content was mixed using a Henschel mixer, to thereby manufacture a "toner 1".

<Manufacture of Toners 2 to 23>

Toners 2 to 23 were manufactured in the same way as the "toner 1", except that the "dispersion (A1) of fine particles of styrene-acrylic resin (1)" was used as a dispersion of resin fine particles for forming the matrix, and the "dispersions of fine particles of amorphous resins (2)" were used as dispersions of resin fine particles for forming the domain, according to the configurations summarized in Table 2.

Among the toners, the toners 1 to 18 relate to the present invention, and toners 19 to 23 relate to comparative examples.

The toner 19 was manufactured using the styrene-acrylic resin (1) only, without adding the amorphous resin (2), and has therefore no domain configured by the amorphous resin (2). The toners 21 and 22 were manufactured using an amorphous resins solely composed of a polyester resin having no vinyl-based segment.

TABLE 2

| TONER | DISPERSION OF FINE PARTICLES OF STYRENE-ACRYLIC RESIN (1) TYPE | DISPERSION OF FINE PARTICLES OF STYRENE-ACRYLIC RESIN (1) [PARTS BY MASS]* | DISPERSION OF FINE PARTICLES OF AMORPHOUS RESIN (2) TYPE | DISPERSION OF FINE PARTICLES OF AMORPHOUS RESIN (2) [PARTS BY MASS]* | HSP VALUE OF AMORPHOUS RESIN (2) $[(J/cm^3)^{1/2}]$ | HSP DISTANCE BETWEEN STYRENE-ACRYLIC RESIN (1) AND AMORPHOUS RESIN (2) $[(J/cm^3)^{1/2}]$ |
|---|---|---|---|---|---|---|
| 1 | A1 | 444 | B3 | 21 | 20.8 | 6.0 |
| 2 | A1 | 422 | B3 | 43 | 20.8 | 6.0 |
| 3 | A1 | 422 | B4 | 43 | 20.6 | 5.8 |
| 4 | A1 | 422 | B5 | 43 | 20.7 | 6.1 |
| 5 | A1 | 422 | B6 | 43 | 20.3 | 5.6 |
| 6 | A1 | 379 | B3 | 86 | 20.8 | 6.0 |
| 7 | A1 | 379 | B4 | 86 | 20.6 | 5.8 |
| 8 | A1 | 379 | B5 | 86 | 20.7 | 6.1 |
| 9 | A1 | 379 | B6 | 86 | 20.3 | 5.6 |
| 10 | A1 | 334 | B4 | 131 | 20.6 | 5.8 |
| 11 | A1 | 334 | B5 | 131 | 20.7 | 6.1 |
| 12 | A1 | 334 | B6 | 131 | 20.3 | 5.6 |
| 13 | A1 | 243 | B4 | 222 | 20.6 | 5.8 |
| 14 | A1 | 243 | B5 | 222 | 20.7 | 6.1 |
| 15 | A1 | 243 | B6 | 222 | 20.3 | 5.6 |
| 16 | A1 | 148 | B4 | 317 | 20.6 | 5.8 |
| 17 | A1 | 148 | B5 | 317 | 20.7 | 6.1 |
| 18 | A1 | 148 | B6 | 317 | 20.3 | 5.6 |
| 19 | A1 | 465 | — | — | — | — |
| 20 | A1 | 452 | B6 | 13 | 20.3 | 5.6 |
| 21 | A1 | 444 | B1 | 21 | 21.5 | 7.3 |
| 22 | A1 | 422 | B1 | 43 | 21.5 | 7.3 |
| 23 | A1 | 422 | B2 | 43 | 22.0 | 8.2 |

| TONER | HSP DISTANCE BETWEEN AMORPHOUS RESIN (2) AND MOLD RELEASING AGENT $[(J/cm^3)^{1/2}]$ | AVERAGE ROUNDNESS | PARTICLE SIZE [mm] | REMARKS |
|---|---|---|---|---|
| 1 | 6.7 | 0.945 | 6.7 | INVENTION |
| 2 | 6.7 | 0.945 | 6.7 | INVENTION |
| 3 | 6.3 | 0.945 | 6.7 | INVENTION |
| 4 | 5.8 | 0.945 | 6.7 | INVENTION |
| 5 | 5.5 | 0.945 | 6.7 | INVENTION |
| 6 | 6.7 | 0.945 | 6.7 | INVENTION |
| 7 | 6.3 | 0.945 | 6.7 | INVENTION |
| 8 | 5.8 | 0.945 | 6.7 | INVENTION |
| 9 | 5.5 | 0.945 | 6.7 | INVENTION |
| 10 | 6.3 | 0.945 | 6.7 | INVENTION |
| 11 | 5.8 | 0.945 | 6.7 | INVENTION |
| 12 | 5.5 | 0.945 | 6.7 | INVENTION |
| 13 | 6.3 | 0.945 | 6.7 | INVENTION |
| 14 | 5.8 | 0.945 | 6.7 | INVENTION |
| 15 | 5.5 | 0.945 | 6.7 | INVENTION |
| 16 | 6.3 | 0.945 | 6.7 | INVENTION |
| 17 | 5.8 | 0.945 | 6.7 | INVENTION |
| 18 | 5.5 | 0.945 | 6.7 | INVENTION |
| 19 | — | 0.945 | 6.7 | COMPARATIVE EXAMPLE |
| 20 | 5.5 | 0.945 | 6.7 | COMPARATIVE EXAMPLE |
| 21 | 7.4 | 0.945 | 6.7 | COMPARATIVE EXAMPLE |
| 22 | 7.4 | 0.945 | 6.7 | COMPARATIVE EXAMPLE |
| 23 | 8.3 | 0.945 | 6.7 | COMPARATIVE EXAMPLE |

*PARTS BY MASS INTERMS OF SOLID CONTENT

The toners 1 to 23 manufactured above were evaluated as follows.

<Evaluation Methods>

(Observation of Domain Structure)

A scanning transmission electron microscope "JSM-7401F" (from JEOL, Ltd.) was used as an evaluation instrument. A sample slice of toner of 100 to 200 nm thick, dyed with $RuO_4$, was observed in a bright field at 10000× magnification, under an acceleration voltage of 30 kV.

The $RuO_4$-dyed sample slice of toner was manufacture as follows.

The toner particle was dispersed in a photo-curable resin "D-800" (from JEOL, Ltd.), allowed to cure under light, to form a block. The block was then sliced using a microtome equipped with a diamond blade, to produce a thin sample slice of 100 to 200 nm thick, and the sample slice was placed on a support film on grid for observation under a transmission electron microscope.

Filter paper was placed in a 5-cm-diameter plastic dish, and the grid having the sample slice placed thereon was placed on the filter paper, with the sample slice faced up. Two or three droplets of a 0.5% $RuO_4$ dying solution were placed at two spots in the dish, the dish was closed with a lid, allowed to stand for 10 minutes, the dish was unlidded, and allowed to stand until water in the dying solution dries up, to prepare the sample to be evaluated.

Dying conditions (time, temperature, concentration and amount of dye) were controlled so as to enable discrimination of the individual resins when observed under the transmission electron microscope.

(Method of Discrimination)

The resin components in the toner base particle were identified based on the criteria below:

Area, looks dark: styrene-acrylic resin (1)

Area, looks bright: amorphous resin (2)

Area, looks bright, with dark boundary: mold releasing agent (Measurement of Diameter, Area and Volume of Domain)

A transmission electron microscope (same as that used in "Observation of Domain Structure"), and an image processor "LUZEX (registered trademark) AP" (from Nireco Corporation) were used as evaluation instruments.

Method of obtaining a toner image to be measured is same as described in "Observation of Domain Structure".

[Evaluation Method]

Twenty-five or more fields of view of the toner base particle image, having the cross sectional diameter within a ±10% range on both sides of the volume-average particle size ($D_{50}$%), were selected for measurement. From these 25 fields of view of the toner base particle image, 200 or more domains of 100 nm or larger, which contain the amorphous resin (2), were randomly selected and subjected to measurement of diameter.

The number-average diameter of domain was calculated as an average value of the horizontal Feret's diameter, and the area of domain was obtained by measuring an actual area of the domains having a particle size of 100 nm or larger. Now the horizontal Feret's diameter is given by the length of an edge, parallel to the x-axis, of a bounding rectangle drawn on a binarized image of the external additive.

The volume of the domain was calculated using the thus-determined diameter of domain and the volume-average particle size of the toner base particle, while assuming each of the domain and the toner base particle as a sphere. The proportion of volume of domain, which contains the amorphous resin (2), contained in the near-the-surface range of the toner base particle was determined first by calculating an abundance proportion of the domain, which contains the amorphous resin (2), in the near-the-surface range of the toner particle, based on the total volume of the domain which contains the amorphous resin (2) contained in the near-the-surface range of the toner base particle, and the total volume of the domains which contains the amorphous resin (2) and resides inside the toner base particle, and then by multiplying the amount of addition (mass) of the amorphous resin (2), by the above-calculated abundance proportion of the domain which contains the amorphous resin (2) in the near-the-surface range of the toner.

<Manufacture of Developer>

Each of the above-manufactured toners 1 to 23 was mixed with a ferrite carrier, with a coating of a copolymer resin (1:1 ratio by mass of monomers) of cyclohexyl methacrylate and methyl methacrylate, and with a volume-average diameter of 60 μm, so as to adjust the toner concentration to 6% by mass, to thereby manufacture developers 1 to 23 to be evaluated. The mixing was implemented using a V-type mixer for 30 minutes.

(1. Low-Temperature Fixability)

The low-temperature fixability was evaluated by loading the thus-manufactured developers one by one, to a developing unit of a commercially available full-color multifunction printer "bizhub PRO C6500" (from Konica Minolta, Inc.). The printer was modified so as to be arbitrarily adjustable in the fixation temperature, amount of adhesion of toner, and system speed. NPi wood free paper of 128 g/m$^2$ (from Nippon Paper Industries Co., Ltd.) was used for evaluation, on which a solid image with an amount of adhesion of toner of 11.3 g/m$^2$ was fixed using at a fixing speed of 300 mm/sec, while varying the temperature of the upper belt from 150 to 200° C. and setting the temperature of the lower fixing roller to be 20° C. lower than the temperature of the upper belt, at 5° C. intervals, so as to find the lower limit temperature of fixation at which no cold offset occurs. The lower the lower limit temperature of fixation, the better the fixability.

(Criteria)

A: lower limit temperature of fixation <150° C.

B: 150° C.≤lower limit temperature of fixation <165° C.

D: 165° C.≤dower limit temperature of fixation (2. Fixation Separability)

A4 paper, having formed thereon a 5-cm wide solid black band image in the direction normal to the feed direction, was fed in the longitudinal direction, while setting the surface temperature of the fixing roller of the multifunction printer at 180° C., and the separability between the fixing roller (heat roller) on the image side and the paper was evaluated according to the criteria below.

(Criteria)

A: Paper separates from fixing roller without curling.

B: Paper separates from fixing roller assisted by separator, leaving almost no trace of separator in image.

C: Paper separates from fixing roller assisted by separator, leaving trace of separator on image.

D: Paper winds around fixing roller, and cannot be separated from fixing roller.

(3. Diversity of Transfer Medium (High Temperature Offset Resistance on Rough Paper)

A solid image was formed on a rough paper ("Hammermill tidal", from International Paper) using the multifunctional printer described above, with a surface temperature of fixing heat roller of 180° C., and an amount of adhesion of toner of 4.0 g/m$^2$. The fixed image was rubbed with a rough paper "Kimwipe S-200" (from Nippon Paper Crecia Co., Ltd.) under a weight with a load of 11.7 N, and dirt caught on the rough paper was evaluated according to the criteria below.

(Criteria)

A: No dirt

B: Almost no dirt

C: Slight dirt

D: Dirt observed

The toners 1 to 23 were thus evaluated. Results were summarized in Table 3.

TABLE 3

| TONER | NUMBER-AVERAGE DOMAIN DIAMETER [mm] | PROPORTION OF TOTAL SECTIONAL AREA OF DOMAIN IN TONER BASE PARTICLE [%] | CONTENT PROPORTION OF AMORPHOUS RESIN (2) TO BINDER RESINS IN TONER BASE PARTICLE [% BY MASS] | AMORPHOUS RESIN (2) |
|---|---|---|---|---|
| 1 | 280 | 4 | 5 | B3 |
| 2 | 345 | 6 | 10 | B3 |
| 3 | 270 | 5 | 10 | B4 |
| 4 | 196 | 3 | 10 | B5 |
| 5 | 154 | 2 | 10 | B6 |
| 6 | 434 | 12 | 20 | B3 |
| 7 | 389 | 11 | 20 | B4 |
| 8 | 312 | 10 | 20 | B5 |
| 9 | 253 | 8 | 20 | B6 |
| 10 | 530 | 18 | 30 | B4 |
| 11 | 445 | 15 | 30 | B5 |
| 12 | 302 | 13 | 30 | B6 |
| 13 | 749 | 31 | 50 | B4 |
| 14 | 701 | 26 | 50 | B5 |
| 15 | 621 | 15 | 50 | B6 |
| 16 | 964 | 48 | 70 | B4 |
| 17 | 916 | 42 | 70 | B5 |
| 18 | 894 | 38 | 70 | B6 |
| 19 | — | — | — | — |
| 20 | 120 | 1 | 3 | B6 |
| 21 | 1500 | 1 | 5 | B1 |
| 22 | 1320 | 5 | 10 | B1 |
| 23 | 1120 | 5 | 10 | B2 |

| | CONTENT | | EVALUATION RESULTS | | | |
|---|---|---|---|---|---|---|
| TONER | PROPORTION OF VINYL SEGMENT IN AMORPHOUS RESIN (2) [% BY MASS] | * | LOW-TEMPERATURE FIXABILITY | FIXATION SEPARABILITY | HIGH TEMPERATURE OFFSET RESISTANCE ON ROUGH PAPER | REMARKS |
| 1 | 5 | 94 | B | C | B | INVENTION |
| 2 | 5 | 88 | A | B | C | INVENTION |
| 3 | 10 | 85 | A | B | B | INVENTION |
| 4 | 20 | 86 | B | B | A | INVENTION |
| 5 | 30 | 84 | B | C | A | INVENTION |
| 6 | 5 | 94 | B | B | B | INVENTION |
| 7 | 10 | 92 | A | A | B | INVENTION |
| 8 | 20 | 85 | A | A | A | INVENTION |
| 9 | 30 | 86 | B | C | A | INVENTION |
| 10 | 10 | 91 | A | A | B | INVENTION |
| 11 | 20 | 85 | A | B | B | INVENTION |
| 12 | 30 | 87 | A | B | B | INVENTION |
| 13 | 10 | 91 | A | A | B | INVENTION |
| 14 | 20 | 88 | A | B | B | INVENTION |
| 15 | 30 | 87 | A | B | B | INVENTION |
| 16 | 10 | 96 | A | C | B | INVENTION |
| 17 | 20 | 92 | A | C | B | INVENTION |
| 18 | 30 | 91 | A | C | B | INVENTION |
| 19 | — | — | D | C | B | COMPARATIVE EXAMPLE |
| 20 | 30 | 77 | D | D | B | COMPARATIVE EXAMPLE |
| 21 | 0 | 97 | D | D | D | COMPARATIVE EXAMPLE |
| 22 | 0 | 94 | B | D | D | COMPARATIVE EXAMPLE |
| 23 | 5 | 94 | B | D | D | COMPARATIVE EXAMPLE |

* ABUNDANCE PROPORTION OF AMORPHOUS RESIN (2) IN NEAR-THE SURFACE RANGE OF TONER BASE PARTICLE [% BY VOLUME]

As is clear from the results, the toners 1 to 18 of the present invention were found to be superior to the toners 19 to 23 of Comparative Examples, in terms of low-temperature fixability, fixation separability and high temperature offset resistance. All of the toners 19 to 23 of Comparative Examples were found to be inferior in either item.

It was also confirmed from observation of the cross sections of the toners 1 to 18 of the present invention and the toners 20 to 23 of Comparative Examples, that the amorphous resin (2) and the mold releasing agent formed independent domains in all of these toners.

What is claimed is:

1. An electrostatic latent image developing toner comprising a toner base particle which contains at least a binder resin, and has a domain-matrix structure, wherein a matrix contains a styrene-acrylic resin, a domain contains an amorphous resin which is formed by combining a vinyl-based polymerized segment and a polyester-based polymerized segment, and the domain containing the amorphous resin and having a diameter of 100 nm or larger has a number-average domain diameter which falls in the range from 150 to 1000 nm.

2. The electrostatic latent image developing toner of claim 1, wherein the number-average domain diameter of the toner base particle falls in the range from 300 to 800 nm.

3. The electrostatic latent image developing toner of claim 1, wherein when a cross section of the toner base particle is dyed with ruthenium tetroxide and observed under an electron microscope, a total cross-sectional area of the domain accounts for 2 to 50% of a cross-sectional area of each the toner base particle.

4. The electrostatic latent image developing toner of claim 1, wherein when a cross section of the toner base particle is dyed with ruthenium tetroxide and observed under an electron microscope, a total cross-sectional area of the domain accounts for 5 to 15% of a cross-sectional area of each the toner base particle.

5. The electrostatic latent image developing toner of claim 1, wherein the binder resin contained in the toner base particle contains 5 to 70% by mass of the amorphous resin.

6. The electrostatic latent image developing toner of claim 1, wherein the binder resin contained in the toner base particle contains 10 to 20% by mass of the amorphous resin.

7. The electrostatic latent image developing toner of claim 1, wherein a proportion of a content of the vinyl-based polymerized segment in the amorphous resin is 5 to 30% by mass.

8. The electrostatic latent image developing toner of claim 1, wherein assuming a radius of the toner base particle as r, and a distance from a surface of the toner base particle to an r/2 point as a near-the-surface range, 80% by volume or more of the amorphous resin resides in the near-the-surface range of the toner base particle.

9. The electrostatic latent image developing toner of claim 1, wherein in the matrix comprising at least the styrene-acrylic resin, the domain of the amorphous resin and a domain of a mold releasing agent are scattered, and the amorphous resin and the mold releasing agent independently form the respective domains.

* * * * *